US006966583B2

(12) United States Patent
Ji et al.

(10) Patent No.: US 6,966,583 B2
(45) Date of Patent: Nov. 22, 2005

(54) GRAVITY-SENSITIVE LATCH

(75) Inventors: Lianli Ji, West Chester, PA (US); Robert Straka, Phoenixville, PA (US); Gerry Clisham, West Chester, PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/801,489

(22) Filed: Mar. 7, 2001

(65) Prior Publication Data

US 2001/0045750 A1 Nov. 29, 2001

Related U.S. Application Data

(60) Provisional application No. 60/188,287, filed on Mar. 7, 2000.

(51) Int. Cl.[7] ..... E05C 3/06

(52) U.S. Cl. ..... 292/231; 292/233; 292/DIG. 22

(58) Field of Search ..... 292/216, 230–232, 292/233, 236, DIG. 37, 130–132, 134, DIG. 22

(56) References Cited

U.S. PATENT DOCUMENTS

| | | | | |
|---|---|---|---|---|
| 2,864,641 A | * | 12/1958 | Leslie | 292/336.3 |
| 3,359,767 A | * | 12/1967 | Arlauskas | 70/264 |
| 4,412,710 A | | 11/1983 | Laprad et al. | |
| 4,534,193 A | | 8/1985 | Takemura et al. | |
| 4,536,021 A | * | 8/1985 | Mochida | 292/201 |
| 4,552,399 A | | 11/1985 | Atarashi | |
| 4,597,599 A | | 7/1986 | Bisbing | |
| 4,703,960 A | | 11/1987 | Lense | |
| 4,799,720 A | | 1/1989 | Watson et al. | |
| 4,838,056 A | | 6/1989 | Weinerman et al. | |
| 4,850,208 A | | 7/1989 | Weinerman et al. | |
| 4,865,368 A | | 9/1989 | McCall et al. | |
| 4,906,044 A | | 3/1990 | Wilstermann | 297/194 |
| 4,969,916 A | | 11/1990 | Weinerman et al. | |
| 5,046,340 A | | 9/1991 | Weinerman et al. | |
| 5,127,686 A | | 7/1992 | Gleason et al. | |
| 5,226,302 A | | 7/1993 | Anderson | |
| 5,234,238 A | | 8/1993 | Takimoto | |
| 5,292,159 A | | 3/1994 | Sandhu et al. | |
| 5,299,844 A | | 4/1994 | Gleason | |
| 5,340,174 A | | 8/1994 | Bender et al. | |
| 5,413,391 A | | 5/1995 | Clavin et al. | |

(Continued)

FOREIGN PATENT DOCUMENTS

| | | |
|---|---|---|
| DE | 29604340 U1 | 5/1996 |
| DE | 19632562 | 2/1998 |

OTHER PUBLICATIONS

Southco– Latches and Hardware Handbook 43, 1993, pp. G–14–G–17.
Southco, Catalog No. 48NA, 1998, p. G–10.
Southco, Handbook 2000, p. 122.
Photograph of physical exhibit—Nissan or Mazda Latch (Item 3).
Photograph of physical exhibit—Lexus Latch (Item 4).
Photograph of physical exhibit—Latch (Item 5).
Photograph of physical exhibit—Nissan Latch (Item 6).
Photograph of physical exhibit—Suzuki Latch (Item 1).
Photograph of physical exhibit—Toyota Latch (Item 2).

*Primary Examiner*—Gary Estremsky
(74) *Attorney, Agent, or Firm*—Paul & Paul

(57) ABSTRACT

The present invention is a gravity-sensitive latch. The latch includes a pendulum pivotally secured between the actuating button or handle and the pawl. When the latch is in a first position, gravity acting on the pendulum rotates the pendulum so that it abuts the button or handle, permitting actuation of the latch. When the latch is in a second orientation, gravity acting on the pendulum rotates the pendulum away from the button or handle, thereby preventing actuation of the latch. The latch may use a wide variety of buttons, handles, or pawl/keeper combinations.

55 Claims, 25 Drawing Sheets

U.S. PATENT DOCUMENTS 5,769,471 A * 6/1998 Suzuki ..... 292/336.3
5,803,537 A 9/1998 Landmeser et al. .... 297/188.19
5,927,772 A 7/1999 Antonucci et al.
5,927,773 A 7/1999 Larsen et al.
5,941,104 A 8/1999 Sadler
6,048,006 A 4/2000 Antonucci et al.
6,149,213 A 11/2000 Sokurenko et al.

* cited by examiner

FIG. 6
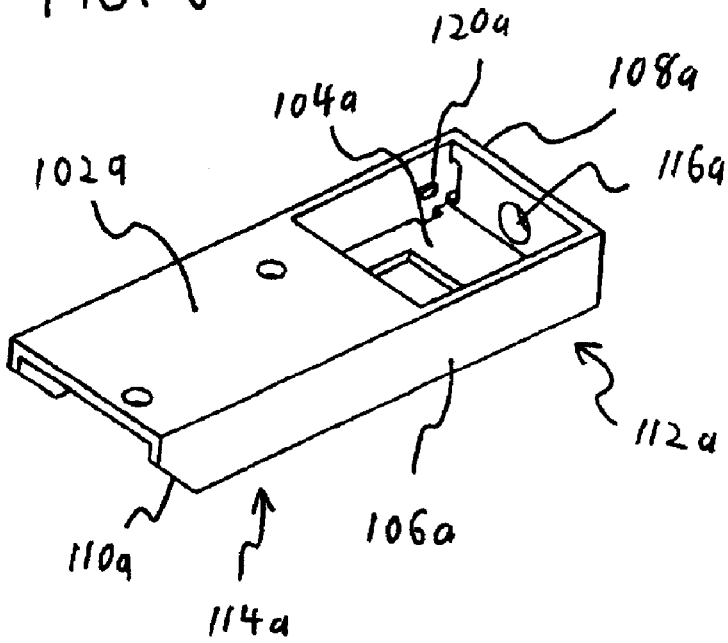
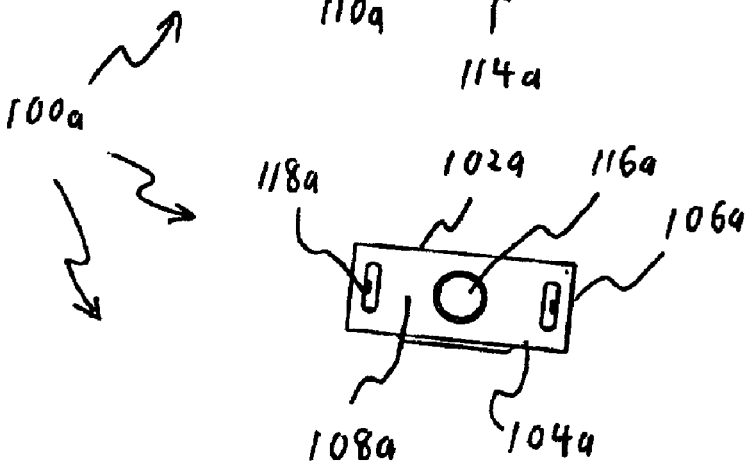
FIG. 7
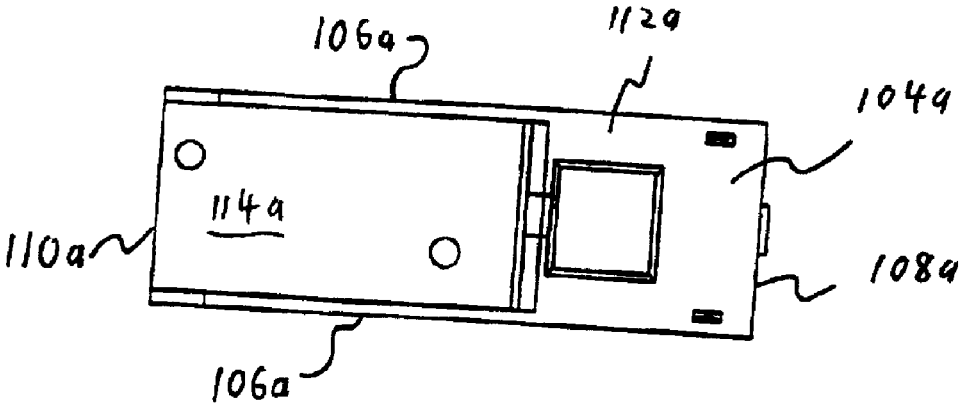
FIG. 8

FIG. 9
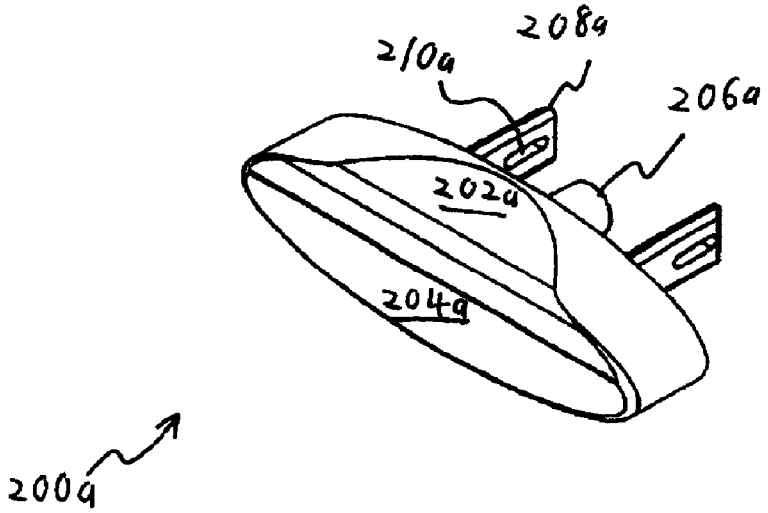
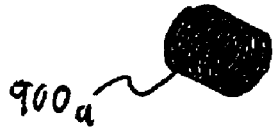
FIG. 10
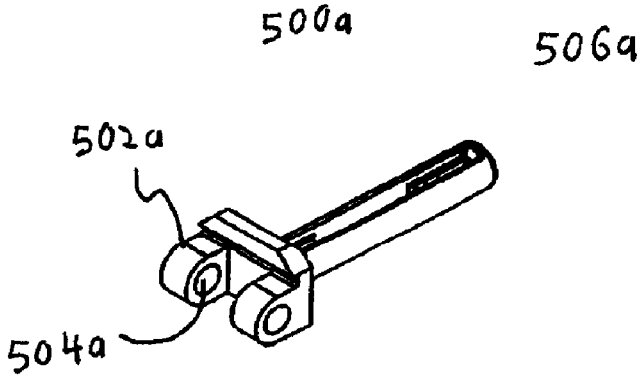
FIG. 11

FIG. 12
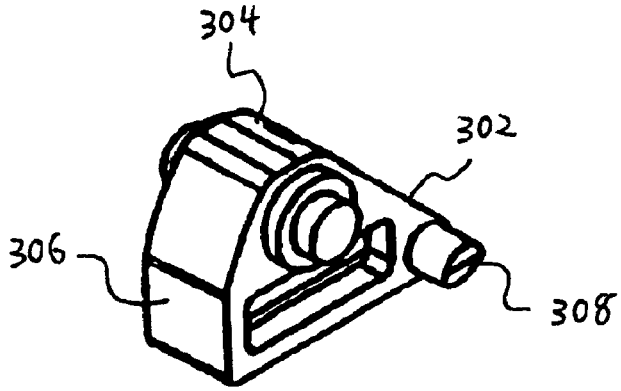
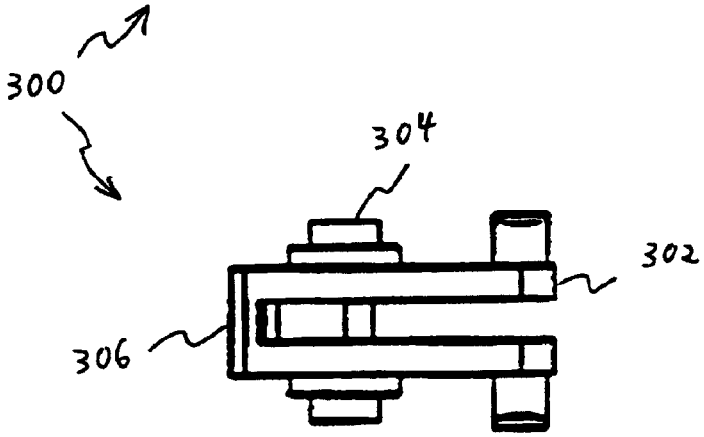
FIG. 13
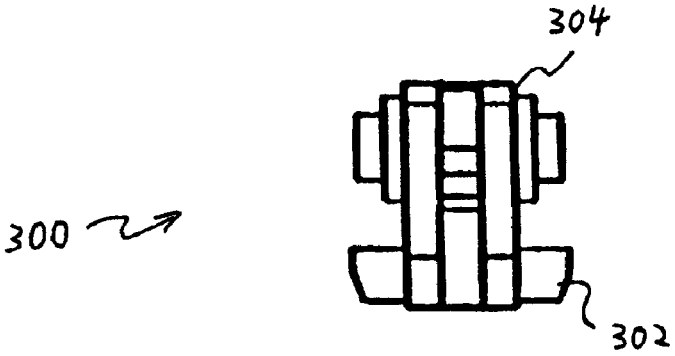
FIG. 14

1006
1008
1010
1012
1014
1016
1018
1020
1022
1024
1026
1028
1030
1032
1034
1036
1038
1040
1042
1044
1046
1048

FIG. 23
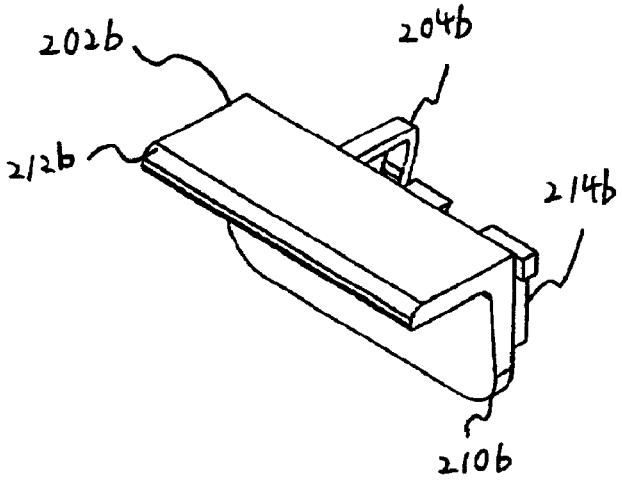
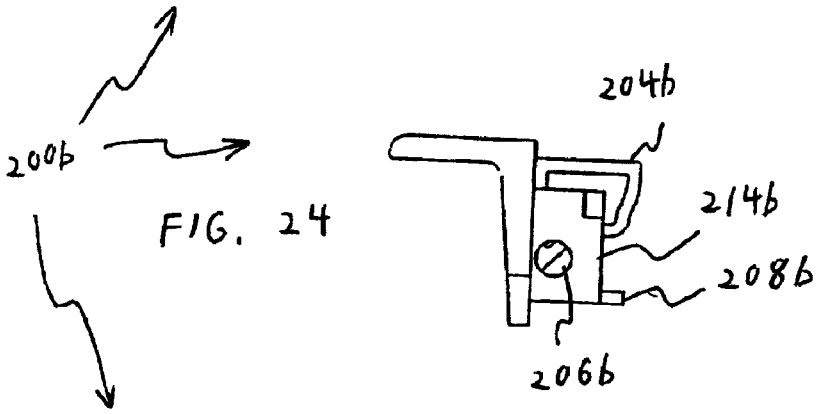
FIG. 24
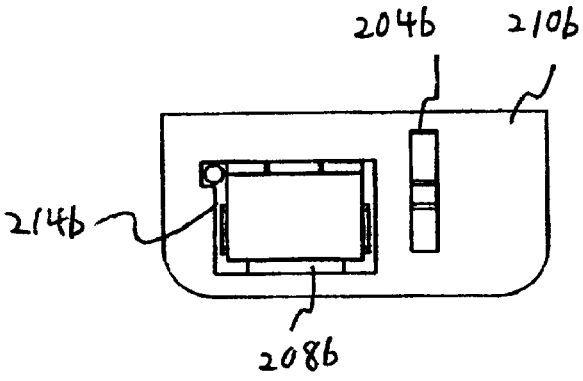
FIG. 25

FIG. 29
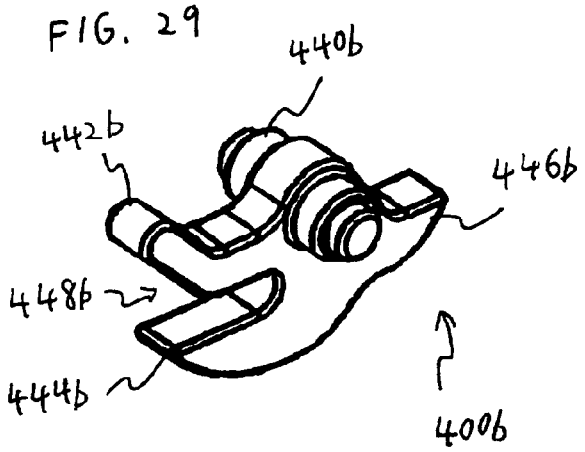
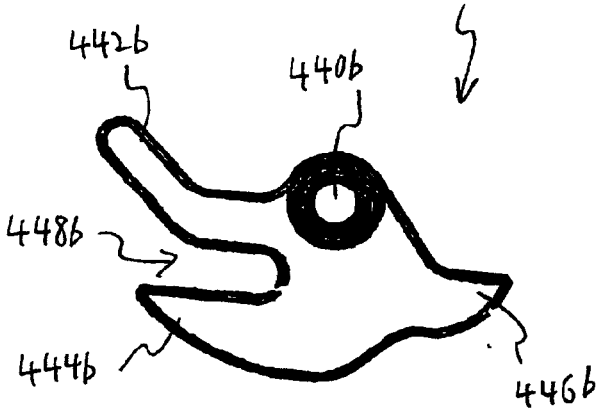
FIG. 30
FIG. 32
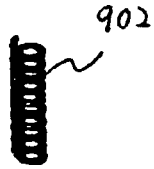
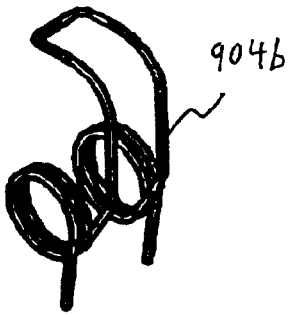
FIG. 31
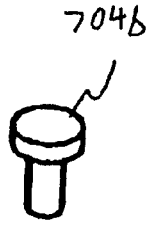
FIG. 33

FIG. 41
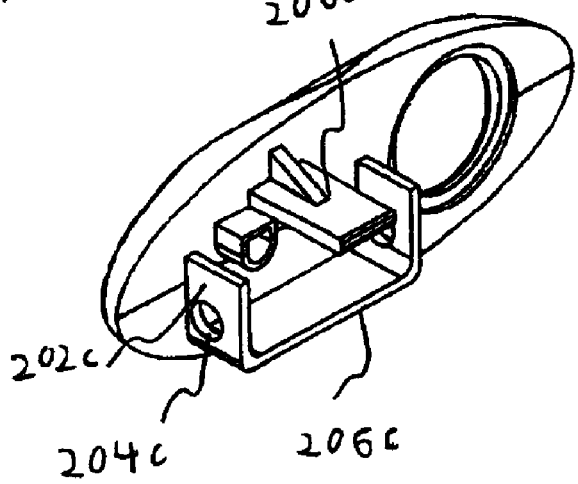
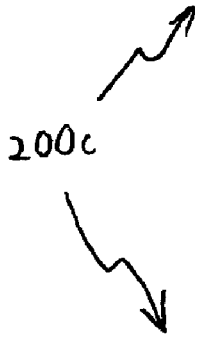
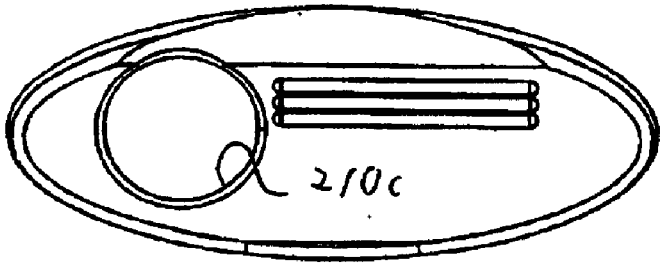
FIG. 42

100c

100c

FIG. 49
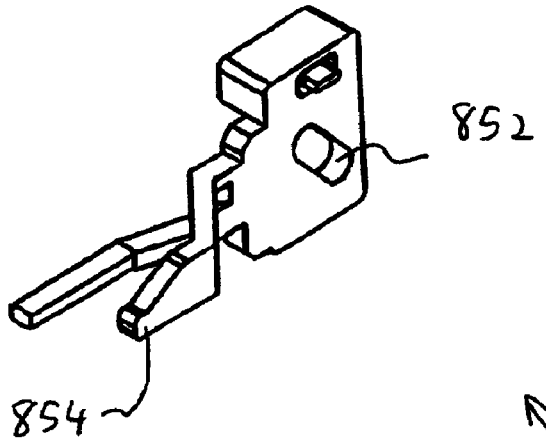
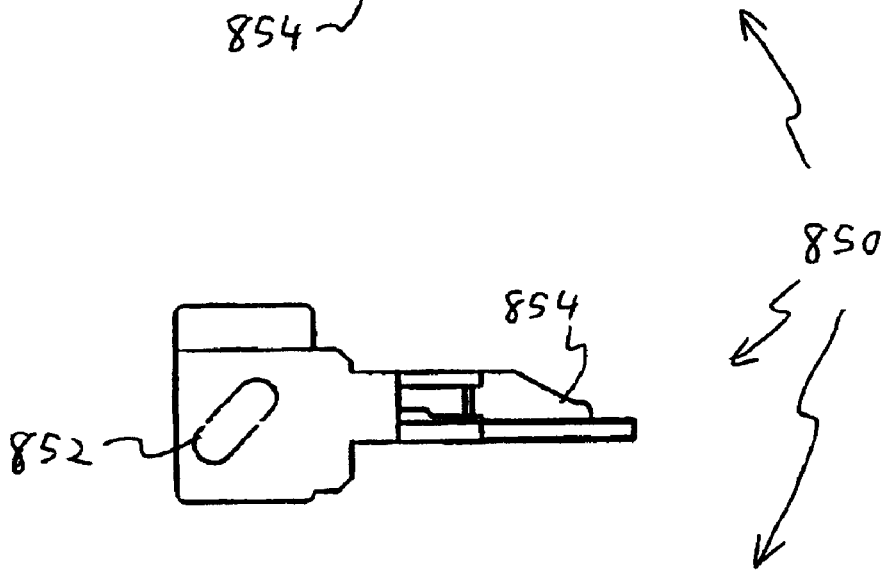
FIG. 50
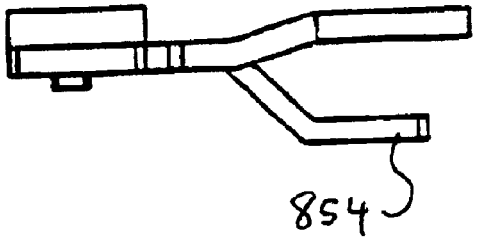
FIG. 51

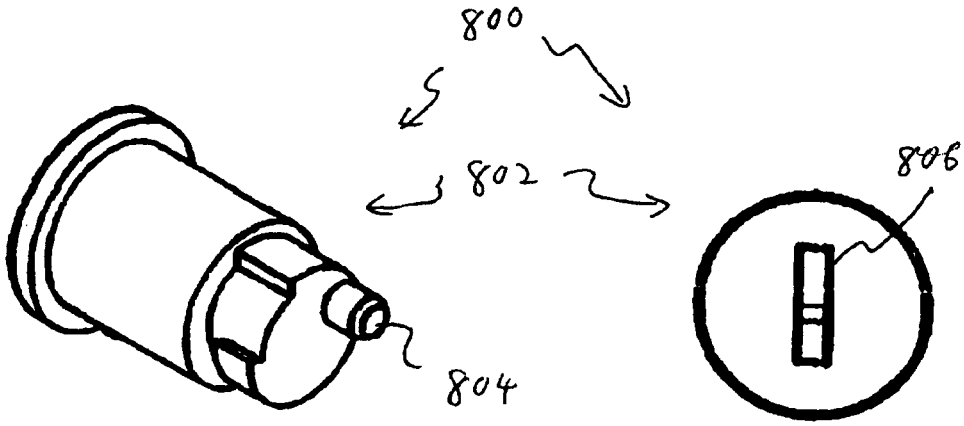
FIG. 54
FIG. 55
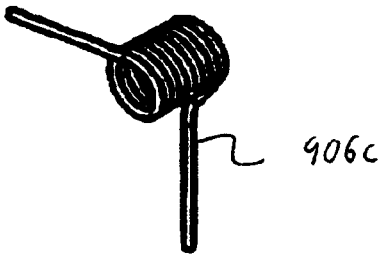
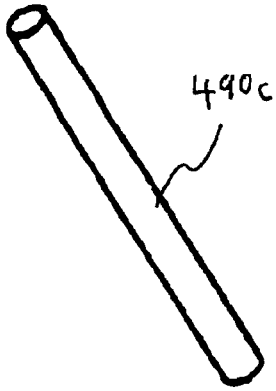
FIG. 56
FIG. 57

GRAVITY-SENSITIVE LATCH

This application claims benefit of provisional application 60/188,287 filed Mar. 7, 2000.

BACKGROUND OF THE INVENTION

1. Field of the Invention

The invention is a gravity-sensitive latch. The latch is operable when in a first orientation, secured in its closed position when in its second orientation.

2. Description of the Related Art

Although other inventors have proposed various means for selectively permitting and preventing opening of a latch, the present inventor is unaware of any other publicly known latches that provide the option of using gravity for this purpose.

Some presently existing latches incorporate a catch fitting within a T-shaped slot in the handle. When the latch is in the closed position, the catch fits within the narrow portion of the T-shaped slot, thereby preventing the handle from being actuated to open the latch. To open the latch, the catch must first be moved to the wide portion to the T-shaped slot. The catch must be moved manually, and does not rely on gravity for automatic movement, unlike the present invention.

While not limited to such use, the present invention is directed towards lids attached to a center console of an automobile. Such consoles sometimes pivot between a horizontal position providing access to the console, and a vertical position wherein the console is contained within the seat back. An example of such a latch is pictured in Southco, Inc. Catalog No. 48 NA, 1998, p. G-10. This latch does not permit the use of gravity to selectively permit or prevent opening of the latch.

Other latches intended for use on automobile consoles use a push-button actuator to control a pair of hooks that engage a keeper in a scissors-like manner. Pushing the button pushes the hooks apart, and releasing the button allows the hooks to come together.

None of the above-referenced publications, taken singly or in combination, is seen to describe the present invention as claimed.

SUMMARY OF THE INVENTION

The invention is a gravity-sensitive latch. When the latch is in a first orientation, such as horizontal, the latch may be actuated. When the latch is in a second orientation, preferably vertical, the latch cannot be actuated. The latch includes a housing, a handle or button, a pendulum, a pawl dimensioned and configured to engage a keeper, and means for connecting the pendulum to the pawl.

The critical feature of all embodiments of the present invention is the pendulum, because the pivoting of the pendulum in response to gravity permits or prohibits actuation of the latch. A preferred and suggested pendulum is triangular in shape, having a connection corner pivotally secured to a pawl assembly, a weighted corner, and an abutment corner dimensioned and configured to abut a corresponding surface of the handle or button.

A housing for a first embodiment of the present invention is preferably rectangular and elongated, with the sides having the largest surface area forming the top and bottom. The top is substantially open within the housing's front portion, and the bottom is substantially open within the rear portion. The housing includes a front end dimensioned and configured to receive a button, preferably including a central aperture and a pair of slots on either side.

The button includes a body having a front surface. A short, wide shaft protrudes from the rear of the button, and is dimensioned and configured to fit within the central aperture of the housing's front. The button includes means for securing to the housing, preferably in the form of flanges on either side of the shaft, dimensioned and configured to fit within the slots on the housing's front. When the button is installed on a latch, the end of the central shaft will abut the abutment corner of the pendulum. The button is spring-biased away from the housing, towards its forward position.

The pendulum is pivotally secured to a connecting rod, which is in turn secured to a pawl. The weighted corner of the pendulum extends upward. A preferred and suggested pawl is configured as a box with a bottom surface having a pawl-engaging aperture. The pawl is secured to the housing by a pawl-retaining bracket, with the pawl-retaining bracket having a second pawl-engaging aperture substantially the same as the pawl's aperture, and located adjacent to this aperture. The pawl reciprocates between a latched position wherein the two apertures are slightly offset from each other, and an unlatched position wherein the apertures are aligned with each other. The pawl is spring-biased towards its latched position. A second spring preferably extends downward from the top of the pawl's box.

A keeper corresponding to the first embodiment of the latch will typically be a cylindrical shaft having a channel around its upper end. The upper end or tip of the keeper has a tapered configuration. Typically, the latch will be secured to a lid, and the keeper will be secured to the frame surrounding the lid.

Latching the latch is accomplished by inserting the keeper into the two apertures in the pawl and flange, causing the tapered tip of the keeper to bias the pawl towards its unlatched position, allowing the keeper to enter the pawl. The pawl's upper spring is thereby compressed. Once the keeper's channel is even with the pawl's bottom surface, the pawl moves under spring pressure towards its latched position, thereby trapping the keeper's channel between the edge of the pawl's aperture and the edge of the pawl retaining flange's aperture.

When the latch is in its horizontal position, the pendulum abuts the central shaft of the button, so that a rearward push on the button pushes rearward on the pendulum. The connecting rod and pawl are thereby also pushed rearward, releasing the keeper's channel from between the pawl aperture and pawl flange's aperture. The pawl's top spring then pushes the keeper out of the latch.

When the latch is in its vertical position, the pendulum pivots away from the button through gravity acting on the pendulum's weighted corner. When the button is pressed rearward, it is thereby prevented from actuating the latch. Rotating the latch into a horizontal position will again pivot the pendulum into engagement with the button, permitting actuation of the latch.

A second embodiment of a latch according to the present invention uses a handle that is pulled to actuate the latch, instead of a button to be pushed. The handle is preferably L-shaped when viewed from either side. The handle includes means for pivotally securing to the housing, and a rearward-projecting flange for abutting the pendulum. The handle preferably includes a stop to prevent travel beyond the desired range of motion. The handle pivots between a latched position and an unlatched position, and is spring-biased towards its latched position.

The pendulum is pivotally secured to a pawl-retaining arm. The pawl-retaining arm is pivotally secured to the housing at its end adjacent to the pawl, permitting it to pivot between a latched position and an unlatched position. The pawl-retaining arm is spring-biased towards its latched position, wherein its opposite end engages a pawl.

The pawl is pivotally secured to the housing. The pawl includes a pair of arms extending towards the handle, and a third arm extending rearward. The rearward arm is dimensioned and configured to engage the pawl-retaining arm. The two forward arms are dimensioned and configured to secure a keeper, which will typically be an inverted U-shaped wire or rod. The pawl pivots between a latched position wherein the two forward arms are substantially horizontal, and an unlatched position wherein the two forward arms point downward. The pawl is spring-biased towards its unlatched position The housing includes a slot dimensioned and configured to receive a keeper.

Typically, the latch will be secured to a lid, and the keeper will be secured to a frame surrounding the lid. When the lid is closed and the keeper enters the housing, it engages the upper forward arm of the pawl, pushing the pawl towards its horizontal position. As the pawl rotates, the pawl's rearward arm pushes the pawl retaining arm rearward, permitting the pawl to rotate into a horizontal position. Once the pawl is horizontal, the pawl-retaining arm moves forward under spring pressure, to a position under the pawl's rear arm. The keeper is thereby secured between the pawl's upper and lower front arms, and by the slot in the housing.

The unlatching of the latch is controlled by the position of the pendulum. When the latch is in its horizontal position, the pendulum abuts the handle, so that an upward pull on the handle will push the pendulum rearward. The paw-retaining arm will thereby also be pushed rearward, releasing the pawl to rotate under spring pressure towards its unlatched position. The keeper can then exit the latch. When the latch is in its vertical position, the pendulum rotates away from the handle, so that a pull on the handle does not push rearward on the pendulum. Rotating the latch back to its horizontal position causes the pendulum to again rotate so that it abuts the handle, permitting actuation of the latch.

A third embodiment of the invention is actuated by depressing a button. The button is pivotally secured to the housing, and includes a flange for abutting the pendulum. The button is spring-biased forward, away from the housing. The pendulum is secured directly to the upper end of a pawl. The pawl of the third embodiment is a vertically oriented plate having a lower end dimensioned and configured to engage a keeper. The pawl is pivotally secured along its central section to the housing, so that a rearward push on the pawl pushes the pawl's lower end forward towards its unlatched position. The pawl is spring-biased towards its rearward latched position.

Typically, the latch will be secured to a lid, and the keeper will be secured to a frame surrounding the lid. A preferred keeper is a plate having an opening dimensioned and configured to receive the pawl. When the latch is closed, the edge of the pawl's ramped lower end strikes the keeper, pushing the lower end of the pawl forward and allowing the pawl to enter the keeper's opening. Once the pawl's lower end clears the edge of the keeper, the pawl returns to its latched position under spring pressure, latching the latch.

Unlatching of the latch is controlled by the position of the pendulum. When the latch is in its horizontal position, the pendulum is rotated to engage the button. Depressing the button will therefore push rearward on the pendulum and the upper end of the pawl, unlatching the latch. When the latch is in a vertical orientation, the pendulum pivots away from the button, so that pressing the button will not unlatch the latch. Rotating the latch to its horizontal orientation will again rotate the pendulum to abut the button, permitting actuation of the latch.

The latch may include a lock for preventing actuation of the latch regardless of its orientation. A preferred and suggested lock includes a standard lock plug having a pin at its rear end, and a locking arm. The locking arm includes a diagonal slot at one end, dimensioned and configured to receive the pin of the lock plug. The opposite end of the locking arm includes a ramp dimensioned and configured to push the pendulum out of engagement with the button. Turning the key in the lock plug rotates the pin, thereby pushing the locking arm under the pendulum, moving the pendulum away from the button. Turning the key in the opposite direction slides the locking arm away from the pendulum, thereby removing the locking arm from engagement with the pendulum and permitting free rotation of the pendulum.

While not limited to such use, a gravity-sensitive latch is particularly useful for the center consoles of automobiles. Such consoles can sometimes rotate into a vertical position to provide additional seating space, or a horizontal position to provide access to storage space within the console. When the console is vertical, it is desirable to prevent accidental opening of the storage compartment therein. When the latch is horizontal, it is desirable to permit access to the storage compartment. A gravity-sensitive latch performs both functions automatically.

It is therefore an object of the present invention to provide a latch that automatically permits actuation when in a first orientation, and precludes actuation when in a second orientation.

It is another object of the present invention to provide a gravity-sensitive latching mechanism useable with a wide variety of buttons and/or handles.

It is a third object of the present invention to provide a gravity-sensitive latching mechanism permitting the use of a wide variety of pawl/keeper combinations.

These and other objects of the invention will become apparent through the following description and claims.

BRIEF DESCRIPTION OF THE DRAWINGS

FIG. 6 is a perspective view of a housing for a first embodiment of a gravity-sensitive latch according to the present invention.

FIG. 7 is a front view of a housing for a first embodiment of a gravity-sensitive latch according to the present invention.

FIG. 8 is a bottom view of a housing for a first embodiment of a gravity-sensitive latch according to the present invention.

FIG. 9 is a perspective view of a button for a first embodiment of a gravity-sensitive latch according to the present invention.

FIG. 10 is a perspective view of a spring for a first embodiment of a gravity-sensitive latch according to the present invention.

FIG. 11 is a perspective view of a connecting rod for a first embodiment of a gravity-sensitive latch according to the present invention.

FIG. 12 is a perspective view of a pendulum for all embodiments of a gravity-sensitive latch according to the present invention.

FIG. 13 is a bottom view of a pendulum for all embodiments of a gravity-sensitive latch according to the present invention.

FIG. 14 is a back view of a pendulum for all embodiments of a gravity-sensitive latch according to the present invention.

FIG. 23 is a perspective view of a handle for a second embodiment of a gravity-sensitive latch according to the present invention.

FIG. 24 is a side view of a handle for a second embodiment of a gravity-sensitive latch according to the present invention.

FIG. 25 is a back view of a handle for a second embodiment of a gravity-sensitive latch according to the present invention.

FIG. 29 is a perspective view of a pawl for a second embodiment of a gravity-sensitive latch according to the present invention.

FIG. 30 is a side view of a pawl for a second embodiment of a gravity-sensitive latch according to the present invention.

FIG. 31 is a perspective view of a pawl spring for a second embodiment of a gravity-sensitive latch according to the present invention.

FIG. 32 is a perspective view of a spring for a pawl-retaining arm for a second embodiment of a gravity-sensitive latch according to the present invention.

FIG. 33 is a perspective view of a pin for a second embodiment of a gravity-sensitive latch according to the present invention.

FIG. 41 is a rear perspective view of a button for a third embodiment of a gravity-sensitive latch according to the present invention.

FIG. 42 is a front view of a button for a third embodiment of a gravity-sensitive latch according to the present invention.

FIG. 49 is a perspective view of a locking arm for a third embodiment of a gravity-sensitive latch according to the present invention.

FIG. 50 is a back view of a locking arm for a third embodiment of a gravity-sensitive latch according to the present invention.

FIG. 51 is a bottom view of a locking arm for a third embodiment of a gravity-sensitive latch according to the present invention.

FIG. 54 is a perspective view of a lock plug for a third embodiment of a gravity-sensitive latch according to the present invention.

FIG. 55 is a front view of a lock plug for a third embodiment of a gravity-sensitive latch according to the present invention.

FIG. 56 is a perspective view of a spring for a third embodiment of a gravity-sensitive latch according to the present invention.

FIG. 57 is a perspective view of a pivot rod for a third embodiment of a gravity-sensitive latch according to the present invention.

Like reference numbers denote like elements throughout the drawings.

DETAILED DESCRIPTION OF THE PREFERRED EMBODIMENTS

Figure 1:
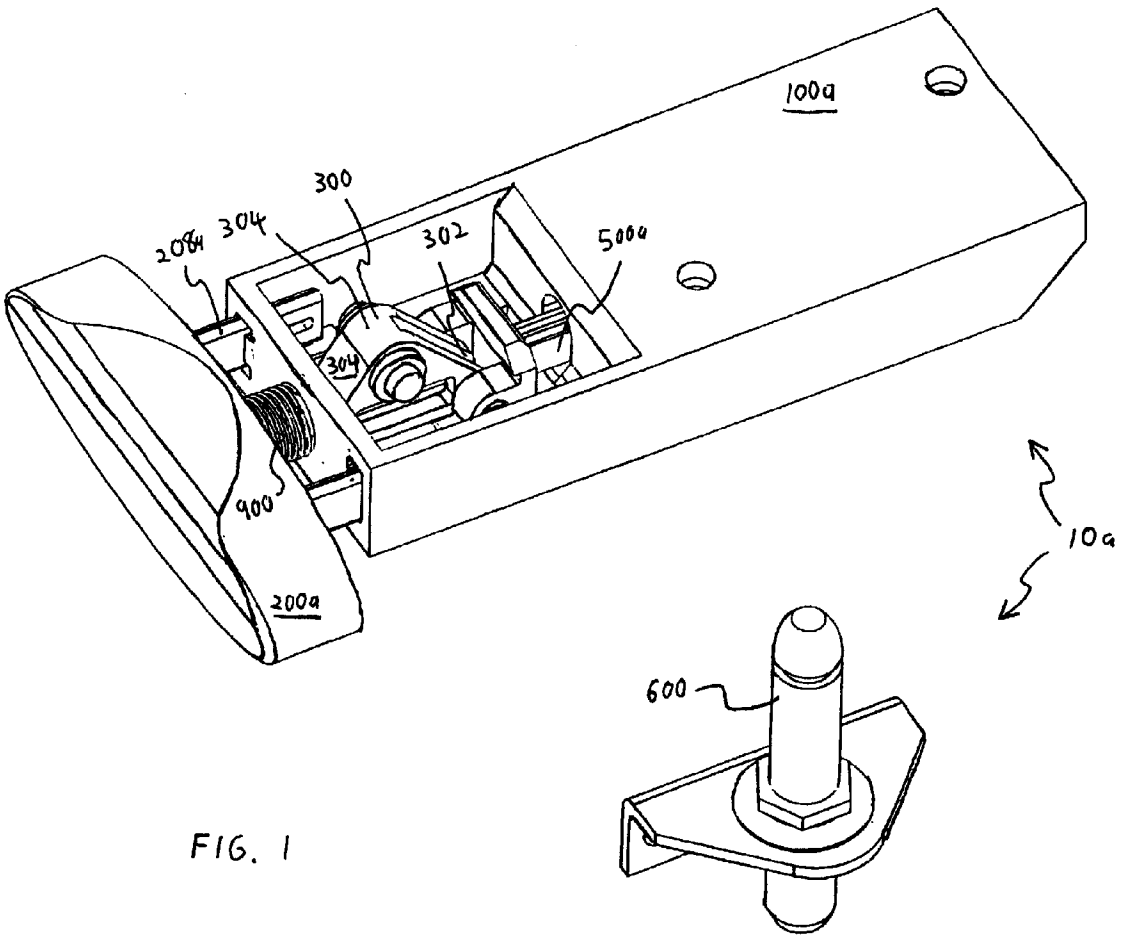
FIG. 1 is a top perspective view of a first embodiment of a gravity-sensitive latch according to the present invention.
Figure 2:
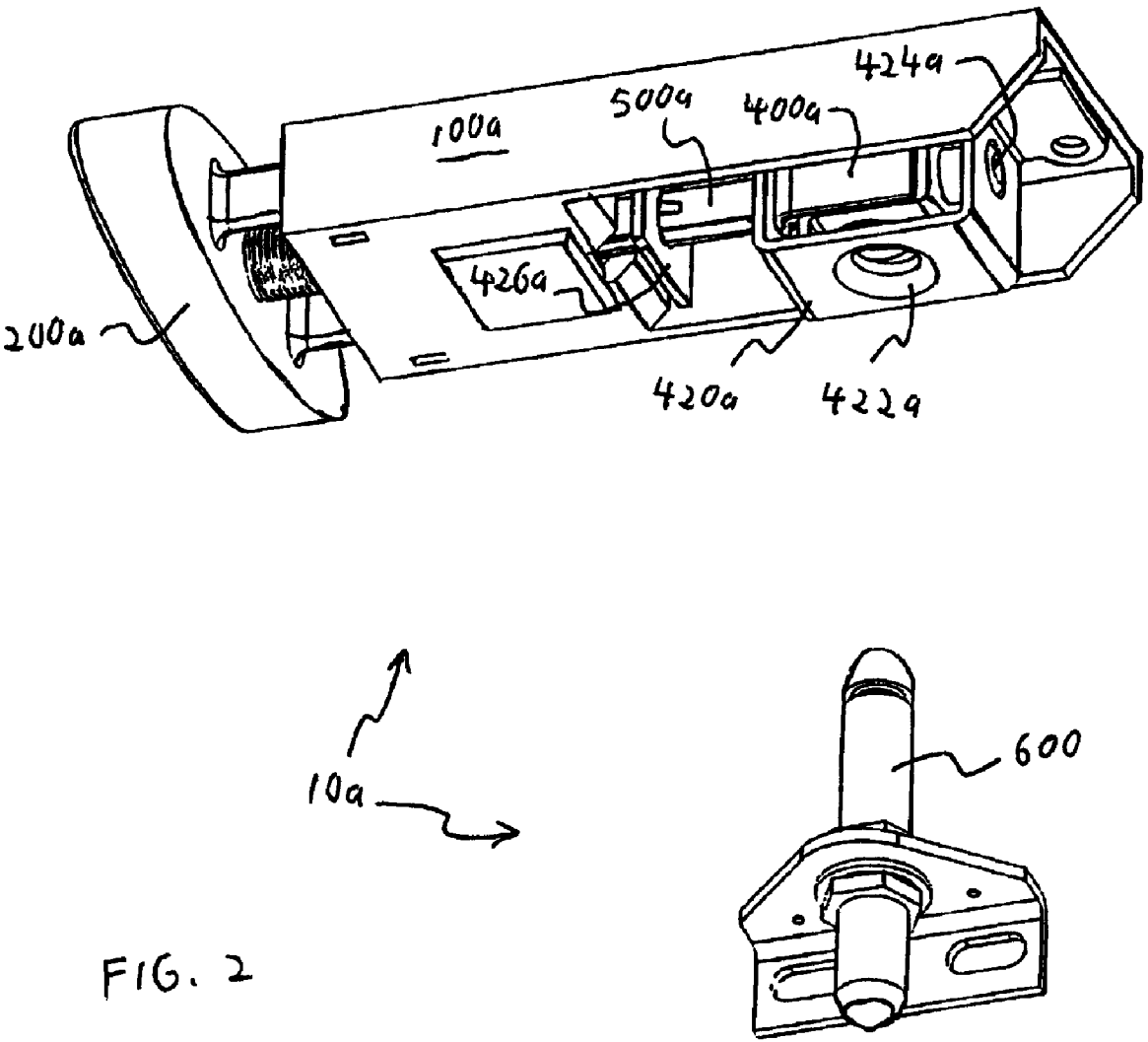
FIG. 2 is a bottom perspective view of a first embodiment of a gravity-sensitive latch according to the present invention.
Figure 3:
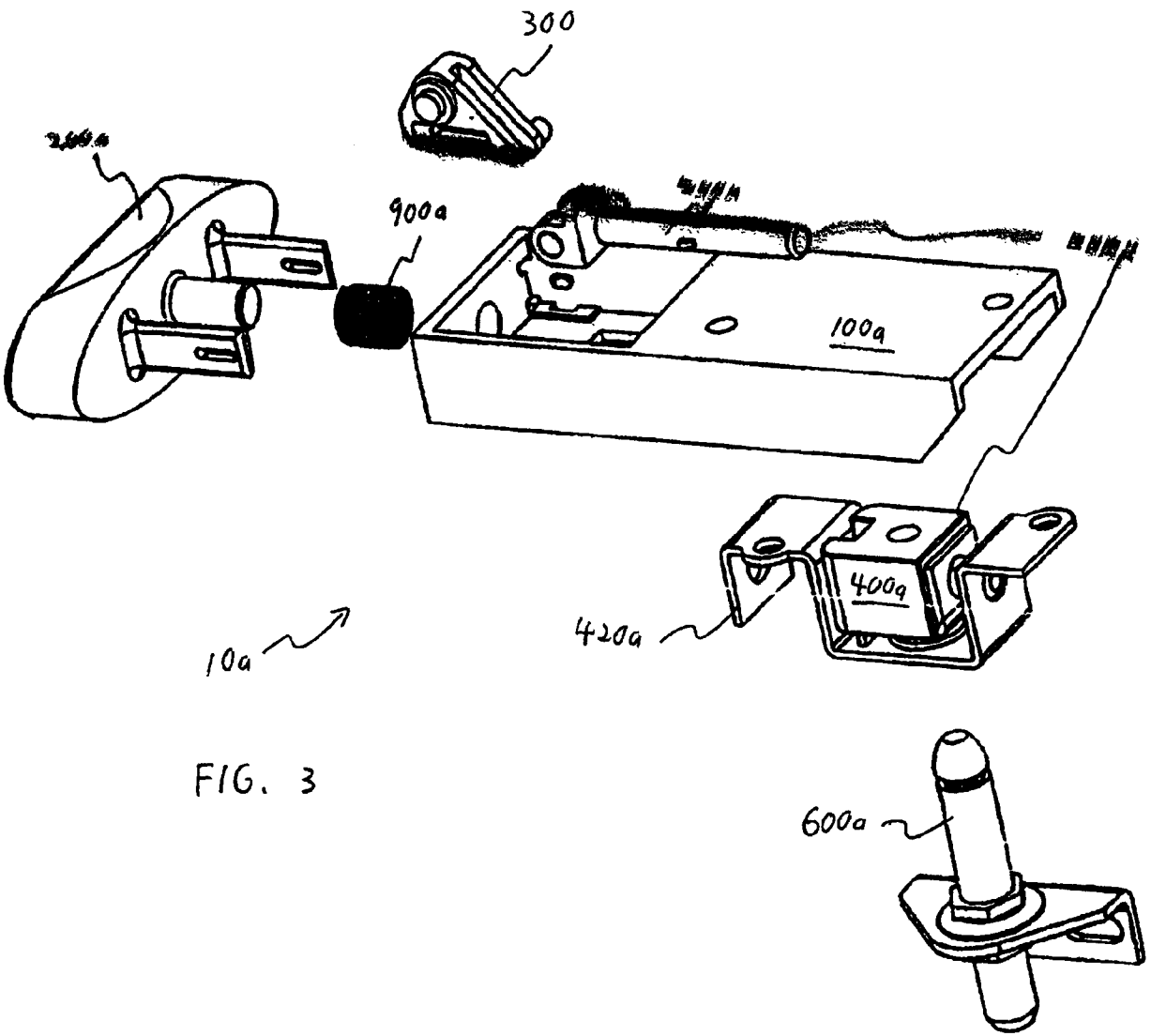
FIG. 3 is a partially exploded, top perspective view of a first embodiment of a gravity-sensitive latch according to the present invention.
Figures 4, 5:
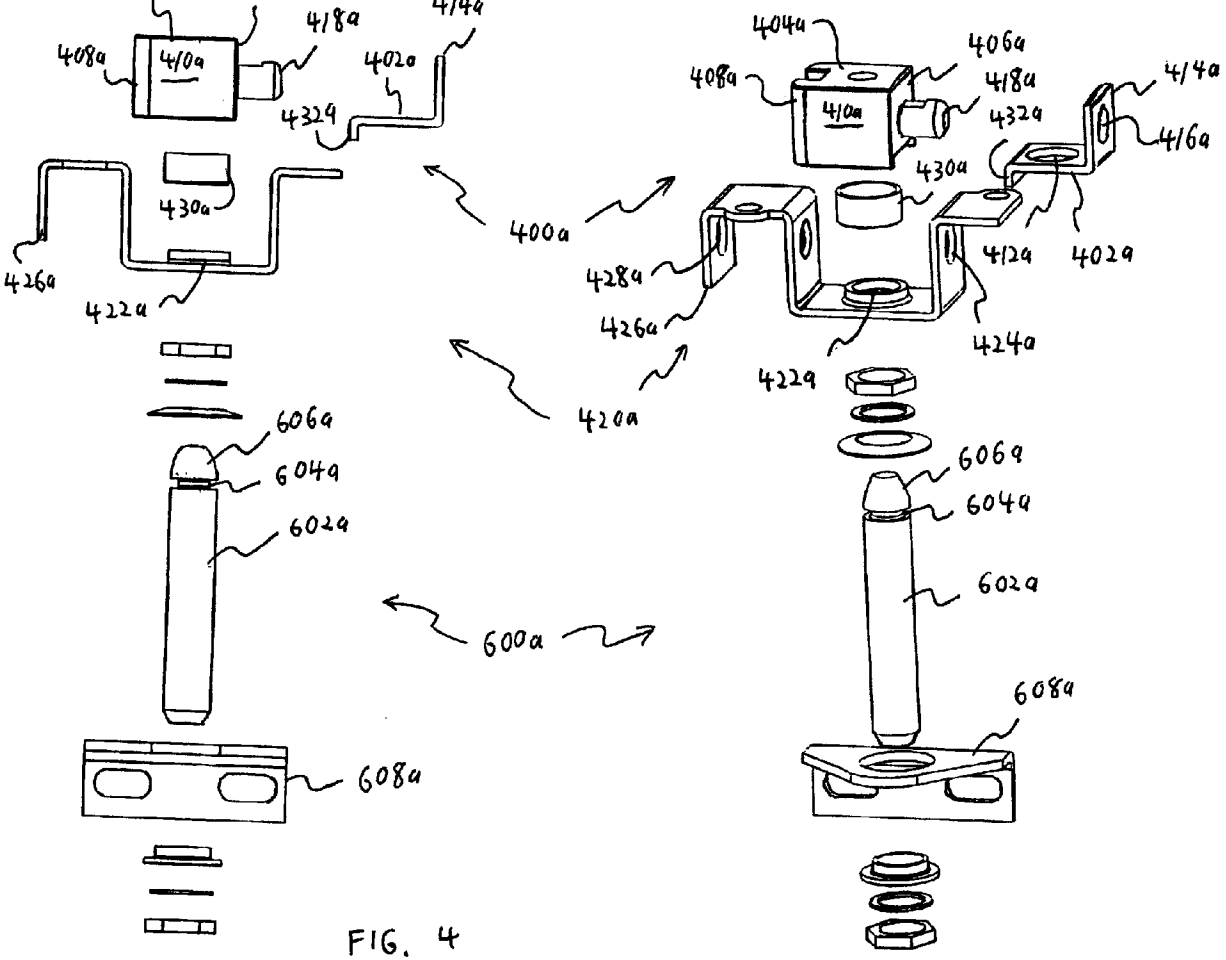
FIG. 4 is an exploded side view of a pawl and keeper assembly for a first embodiment of a gravity-sensitive latch according to the present invention.
FIG. 5 is an exploded perspective view of a pawl and keeper assembly for a first embodiment of a gravity-sensitive latch according to the present invention.

The invention is a gravity-sensitive latch. When the latch is in a first orientation, such as horizontal, the latch may be actuated. When the latch is in a second orientation, preferably vertical, the latch cannot be actuated. Referring to the FIGURES, the latch 10 includes a housing 100, a handle or button 200, a pendulum 300, a pawl 400 dimensioned and configured to engage a keeper, and means for connecting the pendulum to the pawl. Components of specific embodiments of the invention will be referred to herein by reference numbers including a lowercase letter, for example, 10*a* for a first embodiment of a latch. Components included in all embodiments will be referred to by reference numbers by themselves. A first preferred embodiment of a latch is illustrated in FIGS. 1–11, a second preferred embodiment is illustrated in FIGS. 15–33, and a third preferred embodiment is illustrated in FIGS. 33–57.

Referring to FIGS. 12–14, a preferred and suggested pendulum 300, used within all embodiments of the invention, is illustrated. A preferred and suggested pendulum 300 is triangular in shape, having a connection corner 302, a weighted corner 304, and an abutment corner 306 dimensioned and configured to abut a corresponding surface of the handle or button. The connection corner 302 includes means for pivotally securing the pendulum 300 to a pawl or pawl assembly, with preferred and suggested means being a pair of pegs 308 extending perpendicular to the pendulum. The weighted corner 304 has significantly more mass than the remainder of the pendulum 300, ensuring that gravity acting on the pendulum 300 will primarily act on this weighted corner 304. The abutment corner 306 provides a generally flat surface area for abutting a flange extending rearward from a button or handle, as described below.

Referring to FIGS. 6–8, a housing 100*a* for a first embodiment of the present invention is preferably rectangular and elongated, having a top 102*a*, bottom 104*a*, a pair of sides 106*a*, a front end 108*a*, and a back or rear end 110*a*. The top 102*a* is substantially open within the housing's front portion 112*a*, and the bottom 104*a* is substantially open within the rear portion 114*a*. The housing includes a front end 108*a* dimensioned and configured to receive a button, preferably including a central aperture 116*a* and a pair of slots 118*a* on either side, with another aperture 120*a* on each side 106*a*, adjacent to the slots 118*a*.

A button 200*a* for a first embodiment of a latch is illustrated in FIG. 9. The button 200*a* includes a body 202*a* having a front surface 204*a*. A short, wide shaft 206*a* protrudes from the rear of the button, and is dimensioned and configured to fit within the central aperture 116*a* of the housing's front 102*a*. The button includes means for securing to the housing, preferably in the form of flanges 208*a* on either side of the shaft, dimensioned and configured to fit within the slots on the housing's front, and having apertures 210*a*, corresponding to the apertures 120*a* in the housing. A pin (not shown, and well-known) inserted through both the apertures 210*a* and 120*a* will thereby secure the button 200*a* within the housing 100*a*. When the button is installed on a latch, the end of the central shaft 206*a* will pass through the aperture 116*a* to abut the abutment corner 306 of the pendulum 300. The button is spring-biased away from the housing, preferably by a spring 900, illustrated in FIG. 10, surrounding the central shaft 206*a*, towards its forward position.

The pendulum 300 is pivotally secured to a connecting rod 500*a*, illustrated in FIG. 11. The connecting rod 500*a* includes one end having means for pivotally securing the pawl 300, which are preferably a pair of flanges 502*a* defining a pair of apertures 504*a*, with the apertures 504*a* being dimensioned and configured to receive the pegs 308. The opposite end 506*a* is secured to a pawl 400*a*, thereby forming part of a reciprocating pawl assembly 508*a*. The weighted corner 304 of the pendulum 300 is preferably oriented upward. The pawl 400*a* and corresponding keeper 600*a* are best illustrated in FIGS. 1–5. A preferred and suggested pawl 400*a* is configured as a box having a bottom 402*a*, a top surface 404*a*, a back or rear end 406*a*, a front end 408*a*, to which the connecting rod 500*a* is secured, and a pair of sides 410*a*. The bottom 402*a* includes a pawl-engaging aperture 412*a*. A preferred and suggested pawl 400*a* has a bottom 402*a* as a separate component, securing to the rest of pawl 400*a* using an upward flange 414*a*, having an aperture 416*a*. The back 406*a* includes a shaft 418*a*, dimensioned and configured to fit within the aperture 416*a*. The pawl is secured to the housing by a pawl-retaining bracket 420*a*, with the pawl-retaining bracket having a second pawl-engaging aperture 422*a* substantially the same as the pawl's aperture 412*a*, and located adjacent to the aperture 412*a*. A ring 430*a* extends upward from the aperture 422*a*, corresponding in height to a forward flange 432*a* extending downward from the bottom 402*a*. The pawl-retaining bracket 420*a* preferably includes a second aperture 424*a*, dimensioned and configured to receive the shaft 418*a*. The pawl-retaining bracket also preferably includes a forward flange 426*a* defining an aperture 428*a*, dimensioned and configured to guide the connecting rod 500*a*. The pawl 400*a* reciprocates between a latched position wherein the two apertures 412*a*, 422*a* are slightly offset from each other, and an unlatched position wherein the apertures 412*a*, 422*a* are aligned with each other. The pawl is spring-biased towards its latched position, preferably by a spring (not shown) surrounding the shaft 418*a*. A second spring (not shown) preferably extends downward from the top of the pawl's box.

A keeper 600*a* corresponding to the first embodiment of the latch 10*a* will typically include a cylindrical shaft 602*a* having a channel 604*a* around its upper end. The tip 606*a* of the keeper has a tapered configuration. The cylindrical shaft

602*a* will be secured to a mounting bracket 608*a*. Typically, the latch will be secured to a lid, and the keeper will be secured to the frame surrounding the lid.

Latching the latch 10*a* is accomplished by inserting the keeper 600*a* into the two apertures 412*a*, 422*a* in the pawl 400*a* and flange 420*a*. The tapered tip 606*a* of the keeper will bias the pawl 400*a* towards its unlatched position, allowing the keeper 600*a* to enter the pawl 400*a*. The pawl's upper spring is thereby compressed. Once the keeper's channel 604*a* is even with the pawl's bottom surface 402*a*, the pawl 400*a* moves under spring pressure towards its latched position, thereby trapping the keeper's channel 604*a* between the edge of the pawl's aperture 412*a* and the edge of the pawl retaining flange's aperture 422*a*.

When the latch 10*a* is in its horizontal position, the pendulum 400*a* abuts the central shaft 206*a* of the button 200*a*, so that a rearward push on the button 206*a* pushes rearward on the pendulum 300. The connecting rod 500*a* and pawl 400*a* are thereby also pushed rearward, releasing the keeper's channel 604*a* from between the pawl aperture 412*a* and pawl flange's aperture 422*a*. The pawl's top spring then pushes the keeper 600*a* out of the latch 10*a*.

When the latch 10*a* is in its vertical position, the pendulum 300 pivots away from the button 200*a* through gravity acting on the pendulum's weighted corner 304. When the button 200*a* is pressed rearward, it is thereby prevented from actuating the latch 10*a*. Rotating the latch 10*a* into a horizontal position will again pivot the pendulum 300 into engagement with the button's central shaft 206*a*, permitting actuation of the latch 10*a*.

A second embodiment of a latch 10*b* according to the present invention, illustrated in FIGS. 15–33, uses a housing 100*b* such as one illustrated in FIGS. 17–22. The housing 100*b* includes means for pivotally securing a handle 200*b*, which are preferably a pair of pegs 102*b*, protruding outward from the flanges 112*b*, with the pegs 102*b* being dimensioned and configured to fit within corresponding apertures 206*b* on a handle, located at the front portion 104*b* of the housing 100*b*. The central portion 106*b* of the housing 100*b* defines a channel 114*b*, dimensioned and configured to receive a pawl 400*b* and a keeper 600*b*, described below. The channel 114*b* includes a pair of apertures 108*b*, dimensioned and configured to pivotally secure a pawl 400*b* within the housing. The rear portion 110*b* of the housing 100*b* includes an aperture 116*b* dimensioned and configured to receive the pin 704*b*, described below.

The latch 10*b* uses a handle 200*b* that is pulled to actuate the latch, instead of a button to be pushed. The handle 200*b*, illustrated in FIGS. 23–25, is preferably L-shaped when viewed from either side 202*b*, including a vertical portion 210*b* and a horizontal portion 212*b*. The handle 200*b* includes means for pivotally securing to the housing 100*b*, preferably in the form of apertures 206*b*, defined within the flanges 214*b* protruding from the vertical portion 210*b*, and a rearward projecting flange 204*b* dimensioned and configured to abut the pendulum. The handle 200*b* preferably includes a stop 208*b* to prevent travel beyond the desired range of motion. The handle 200*b* pivots between a latched position and an unlatched position, and is spring-biased towards its latched position, preferably by the spring 902. A preferred handle 200*b* has the apertures 206*b* positioned below the flange 204*b* and spring 902, so that lifting up on the horizontal portion 212*b* will compress the spring 902 (FIG. 32) and move the flange 204*b* rearward.

Figure 26:
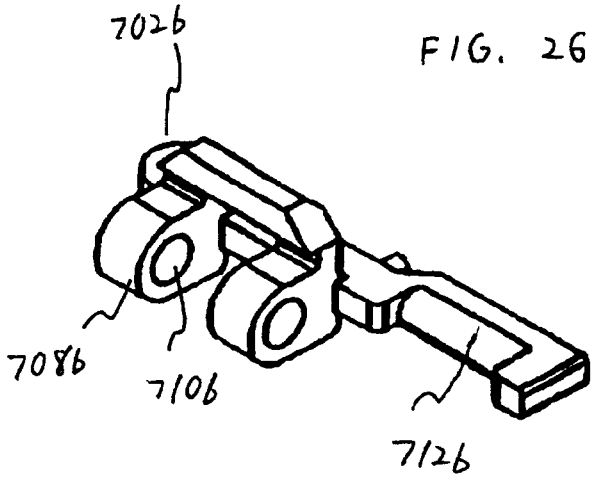
FIG. 26 is a perspective view of a pawl-retaining arm for a second embodiment of a gravity-sensitive latch according to the present invention.
Figure 27:
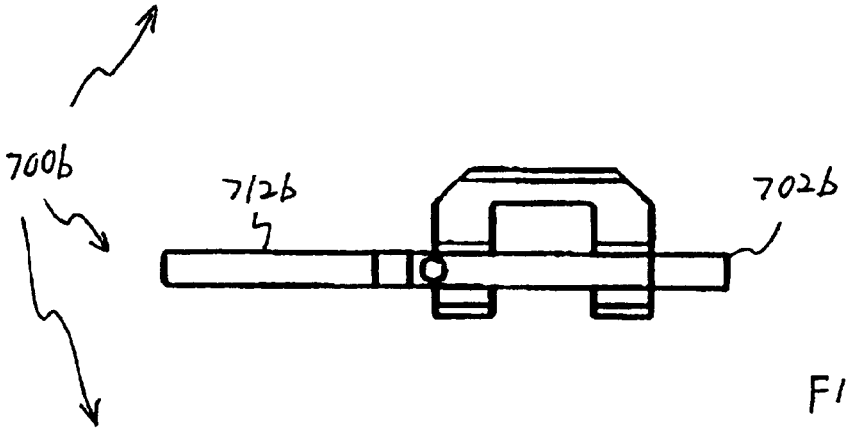
FIG. 27 is a back view of a pawl-retaining arm for a second embodiment of a gravity-sensitive latch according to the present invention.
Figure 28:
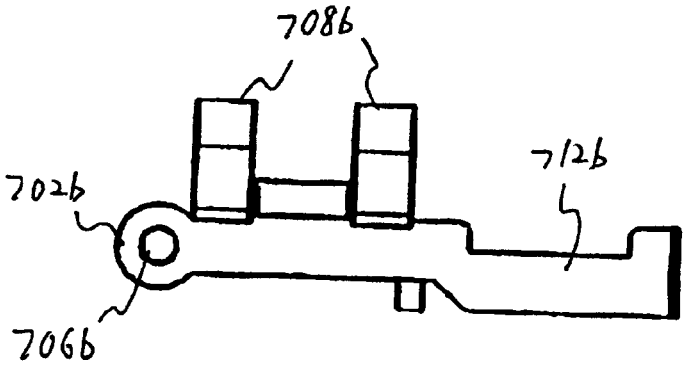
FIG. 28 is a bottom view of a pawl-retaining arm for a second embodiment of a gravity-sensitive latch according to the present invention.

The pendulum 300 is pivotally secured to a pawl-retaining arm 700*b*, illustrated in FIGS. 26–28. The pawl-retaining arm 700*b* is pivotally secured to the housing 100*b* at its end 702*b* adjacent to the pawl, preferably by pin 704*b* (FIG. 33) passing through the aperture 706*b* within the pawl-retaining arm 700*b* and into the corresponding aperture within the housing 100*b*. The pawl-retaining arm 700*b* is thereby permitted to pivot between a latched position and an unlatched position. The pawl-retaining arm 700*b* includes means for pivotally securing the pendulum 300, which are preferably a pair of flanges 708*b*, each defining an aperture 710*b*, dimensioned and configured to receive the pendulum's pegs 308. The pawl-retaining arm's opposite end 712*b* is dimensioned and configured to engage a pawl 400*b*, as described below. The pawl-retaining arm is spring-biased towards its latched position, preferably by a second spring 902, wherein it engages the pawl 400*b*.

A preferred pawl 400*b* is illustrated in FIGS. 29–30. The pawl 400*b* includes means for pivotally securing to the housing 100*b*, which are preferably a pair of pins 440*b*, dimensioned and configured to fit within the apertures 108*b*. The pawl includes an upper forward arm 442*b*, a lower forward arm 444*b*, defining a channel 448*b* therebetween, and a rearward arm 446*b*. The rearward arm 446*b* is dimensioned and configured to engage the pawl-retaining arm 700*b*. The channel 448*b* is dimensioned and configured to secure a keeper 600*b*, which will typically be an inverted U-shaped wire or rod. The pawl 400*b* pivots between a latched position wherein the two forward arms 442*b*, 444*b* are substantially horizontal, and an unlatched position wherein the two forward arms 442*b*, 444*b* point downward. The pawl 400*b* is spring-biased towards its unlatched position, preferably by a pawl spring 904*b* as illustrated in FIG. 31.

Typically, the latch 10*b* will be secured to a lid, and the keeper 600*b* will be secured to a frame surrounding the lid. When the lid is closed and the keeper 600*b* enters the housing 100*b*, it engages the upper forward arm 442*b* of the pawl 440*b*, pushing the pawl 400*b* towards its horizontal position. As the pawl 400*b* rotates, the pawl's rearward arm 446*b* pushes the pawl retaining arm 700*b* rearward, permitting the pawl 400*b* to rotate into a horizontal position. Once the pawl 400*b* is horizontal, the pawl-retaining arm 700*b* moves forward under spring pressure, to position above the pawl's rear arm 446*b* thereby stopping counterclockwise rotation of the pawl 400*b*. The keeper 600 is thereby secured with the channel 448*b*, and by the channel 114*b* in he hosing 100*b*.

The unlatching of the latch 10*b* is controlled by the position of the pendulum 300. When the latch 10*b* is in its horizontal position, the pendulum 300 abuts the handle 200*b*, so that an upward pull on the handle 200*b* will push the pendulum 300 rearward. The pawl-retaining arm 700*b* will thereby also be pushed rearward, releasing the pawl 400*b* to rotate under spring pressure towards its unlatched position. The keeper 600*b* can then exit the latch 10*b*. When the latch 10*b* is in its vertical position, the pendulum 300 rotates away from the handle 200*b*, so that a pull on the handle 200*b* does not push rearward on the pendulum 300. Rotating the latch 10*b* back to its horizontal position causes the pendulum 300 to again rotate so that it abuts the handle 200*b*, permitting actuation of the latch 10*b*.

Figure 15:
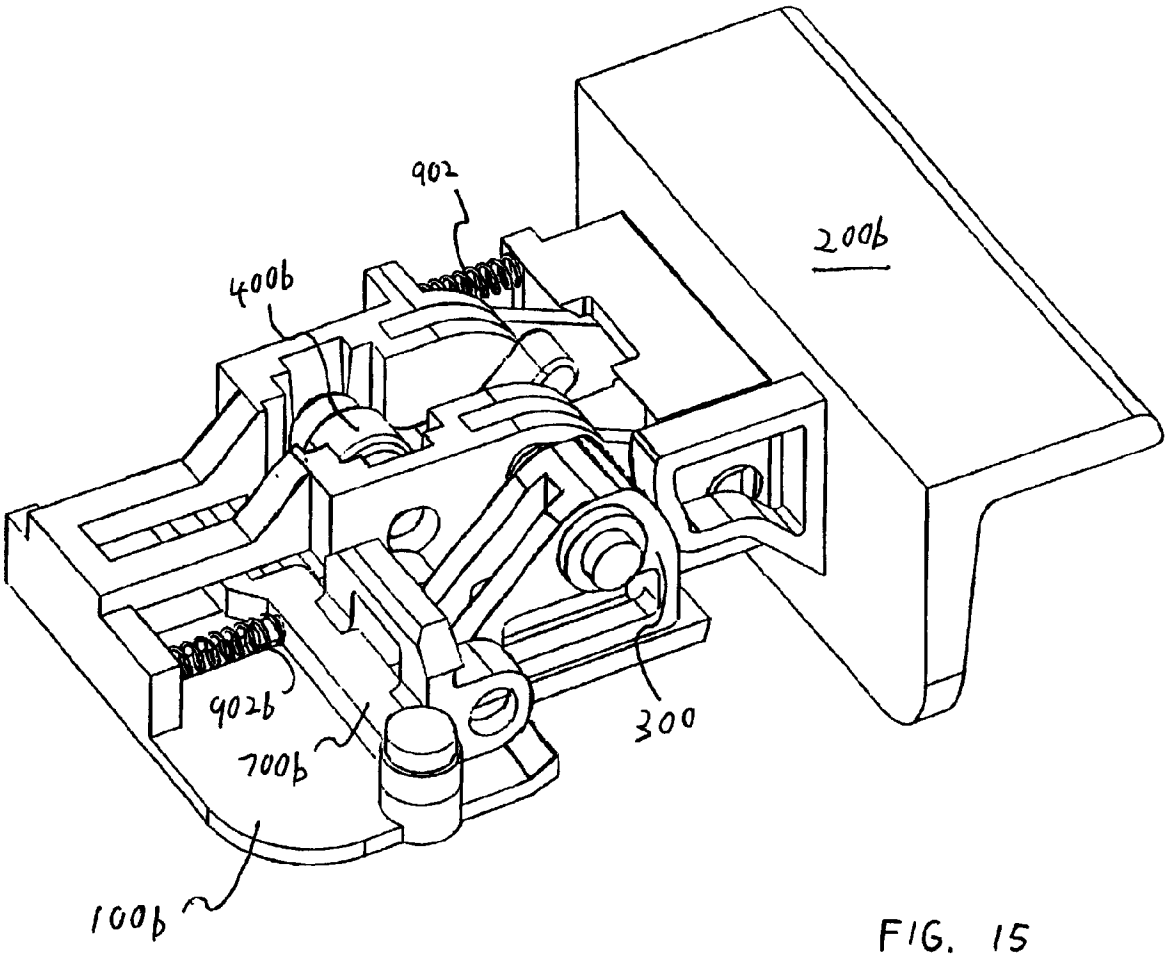
FIG. 15 is a top perspective view of a second embodiment of a gravity-sensitive latch according to the present invention.
Figure 16:
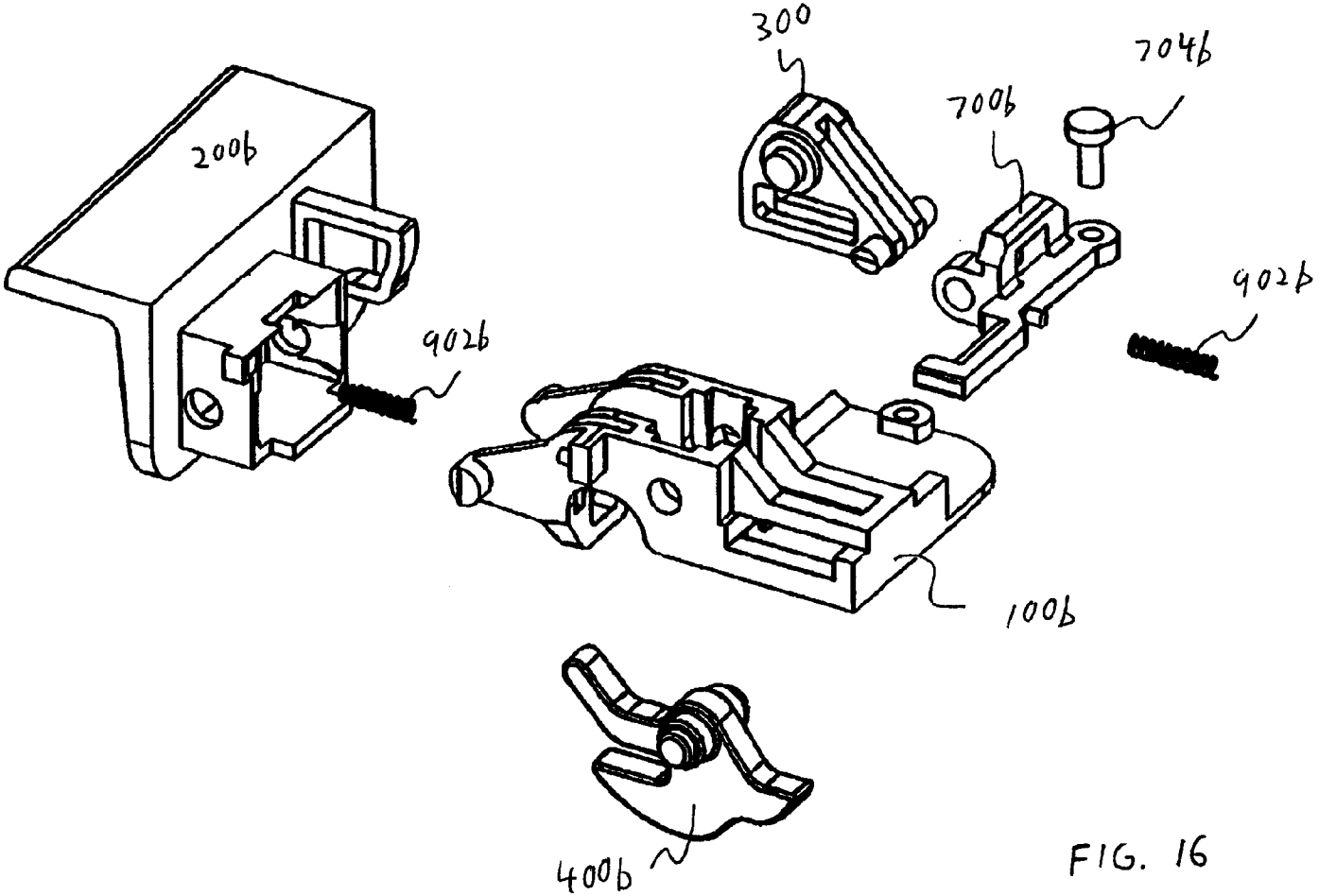
FIG. 16 is an exploded top perspective view of a second embodiment of a gravity-sensitive latch according to the present invention.
Figures 17, 18, 19, 20, 21, 22:
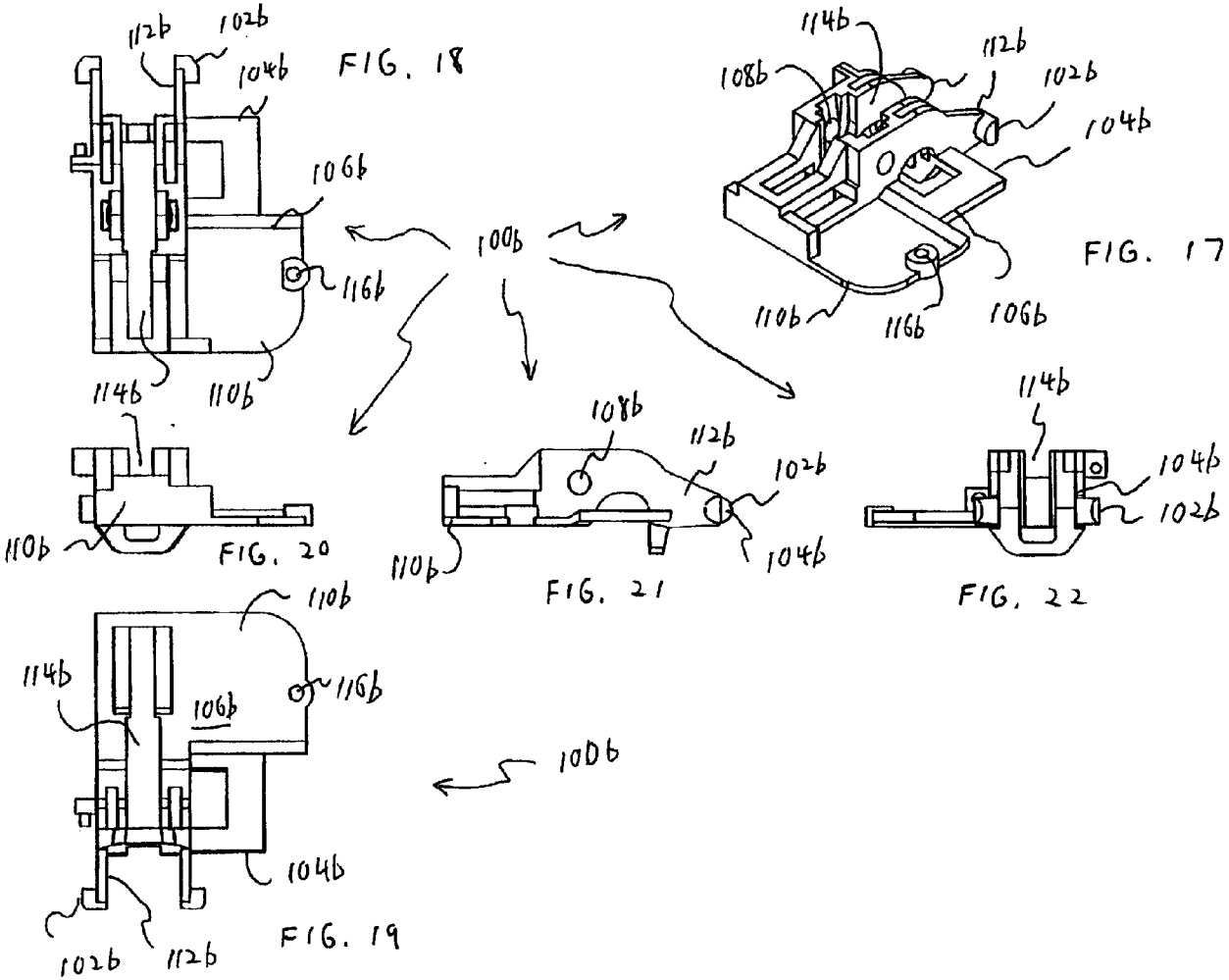
FIG. 17 is a perspective view of a housing for a second embodiment of a gravity-sensitive latch according to the present invention.
FIG. 18 is a top view of a housing for a second embodiment of a gravity-sensitive latch according to the present invention.
FIG. 19 is a bottom view of a housing for a second embodiment of a gravity-sensitive latch according to the present invention.
FIG. 20 is a back view of a housing for a second embodiment of a gravity-sensitive latch according to the present invention.
FIG. 21 is a side view of a housing for a second embodiment of a gravity-sensitive latch according to the present invention.
FIG. 22 is a front view of a housing for a second embodiment of a gravity-sensitive latch according to the present invention.

From the foregoing it is understood that in operation, this second embodiment is assembled to mechanically link the handle 200*b* to the retaining arm 700*b* though the pendulum 300 when the latch 10*b* is in the horizontal position, FIG. 15. Whereby when the handle 200*b* is moved, its rearward projecting flange 204*b* moves against the pendulum 300 which then moves the retaining arm 700*b* as the pendulum 300 is permanently linked to the retaining arm at the apertures 710*b* and when the latch 10*b* is in the horizontal position the pendulum 300 is interposed between the handle 200*b* and the retaining arm 700*b*. The retaining arm 700*b* thereby pivots on its pivot pin 704*b* and moves from engagement with the pawl 400*b*, permitting the pawl 400*b* to rotate under operation of its spring-biasing to the unlatched position. Specifically, the retaining arm 700*b* had its opposite end 712*b* dimensioned and configured to engage the pawl 400*b* at its rearward arm 446*b*. When the retaining arm opposite end 712*b* engages the pawl 400*b* at its rearward arm 446*b* the pawl is thereby interlocked from movement.

When the latch 10*b* is in its vertical position it has rotated to disconnect the handle 200*b* from the retaining arm 700*b*. This unlinking occurs because the pendulum 300 has pivoted away, under the force of gravity, from being interposed between the handle 200*b* and the retaining arm 700*b*. In this non-interposed state the path of operation of the rearward projecting flange 204*b* of the handle 200*b* is no longer capable of contacting the pendulum 300 and the rearward motion of the flange 204*b* when the handle 200*b* is operated while the latch 10*b* is in the vertical position has no effect on the operation of the latch 10*b*.

A third embodiment of the latch 10*c* is illustrated in FIGS. 34–57. The housing 100*c* is illustrated in FIGS. 43–48. The front of the housing includes means for securing a button, which is preferably a pair of pegs 102*c*. The rear portion of the housing defines means for pivotally securing a pawl 400*c*, which preferably include a pair of flanges defining a pair of apertures 104*c* dimensioned and configured to receive a pivot rod 490*c*, illustrated in FIG. 57.

The latch 10*c* is actuated by depressing a button 200*c*, illustrated in FIGS. 41–42. The button 200*c* includes means for pivotally securing to the housing, preferably including a flange 202*c* protruding from the button's rear, with the flange 202*c* defining a pair of apertures 204*c*, dimensioned and configured to receive the pegs 102*c* of the housing 100*c*. The button 200*c* also includes a flange 208*c* for abutting the pendulum, and a flange 206*c* for limiting travel of the button. The button is spring-biased forward, away from the housing, preferably by a spring 902. The button may include an aperture 210*c*, dimensioned and configured to receive a lock 800, described below.

Figure 52:
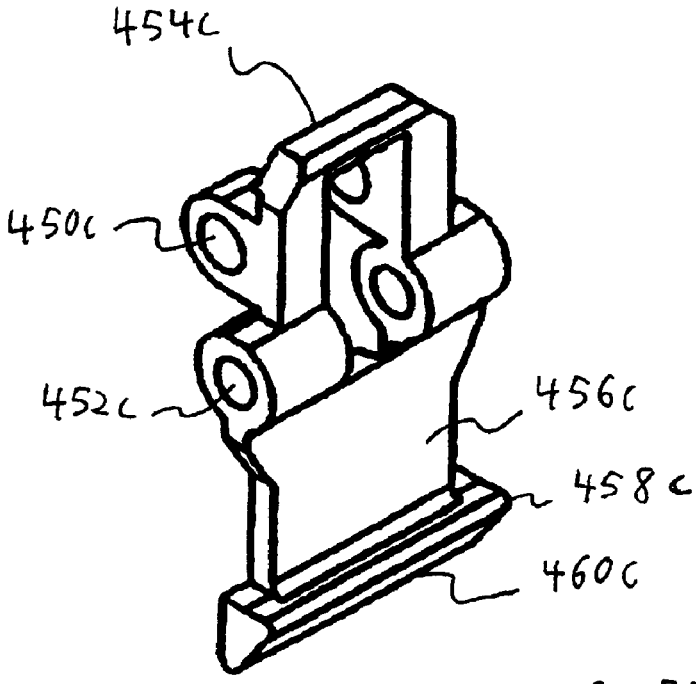
FIG. 52 is a perspective view of a pawl for a third embodiment of a gravity-sensitive latch according to the present invention.
Figure 53:
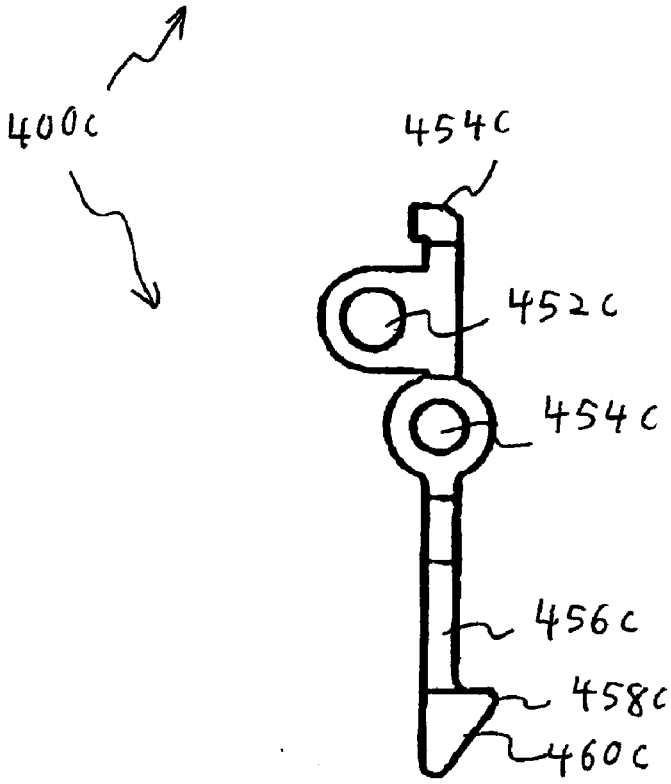
FIG. 53 is a side view of a pawl for a third embodiment of a gravity-sensitive latch according to the present invention.

The pendulum 300 is secured directly to the upper end of a pawl 400*c*, illustrated in FIGS. 52–53. The pawl includes an upper end 454*c*, and a lower end 456*c*. The upper end 454*c* of the pawl 400*c* includes means for pivotally securing the pendulum 300, which preferably include a pair of apertures 450*c* dimensioned and configured to receive the pegs 308 of the pendulum. The central section of the pawl defines means for pivotally securing the pawl to the housing, preferably at least one aperture 452*c*, dimensioned and configured to receive the rod 490*c*. The rod 490*c* passing through the apertures 452*c* and 104*c* thereby pivotally secures the pawl 400*c* vertically on the housing 100*c*. The lower end 456*c* includes a hook 458*c*, dimensioned and configured to engage a keeper 600*c*. The lower portion of the hook 458*c* includes a ramped portion 460*c*. The pawl pivots between a latched position wherein the lower end 456*c* is rearward, and an unlatched position wherein the lower end 456*c* is forward. It is now apparent that a rearward push on the pawl 400*c* by the pendulum 300 pushes the pawl's lower end 456*c* forward towards its unlatched position. The pawl 400*c* is spring-biased towards its rearward latched position, preferably by a spring 906*c*, illustrated in FIG. 56.

Typically, the latch 10*c* will be secured to a lid, and the keeper 600*c* will be secured to a frame surrounding the lid. A preferred keeper 600*c* is a plate having an opening 602*c* dimensioned and configured to receive the pawl's hook 458*c*. When the latch 10*c* is closed, the pawl's ramp 460*c* strikes the keeper 600*c*, pushing the lower end 456*c* of the pawl 400*c* forward and allowing the pawl 400*c* to enter the keeper's opening 602*c*. Once the pawl's lower end 456*c* clears the edge of the keeper 600*c*, the pawl 400*c* returns to its latched position under spring pressure, latching the latch 10*c*.

Figure 34:
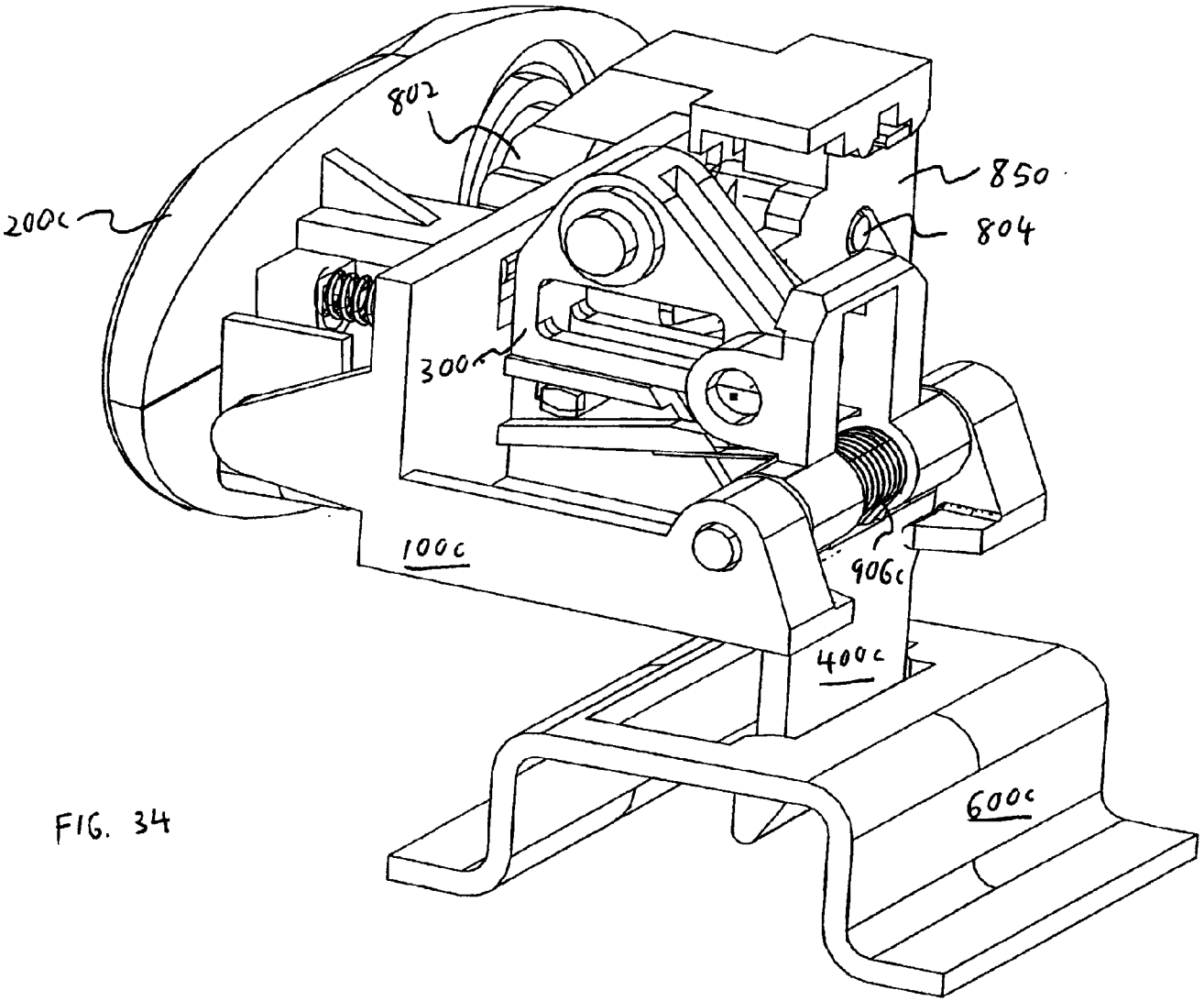
FIG. 34 is a side perspective view of a third embodiment of a gravity-sensitive latch according to the present invention, showing the pendulum abutting the button.
Figure 35:
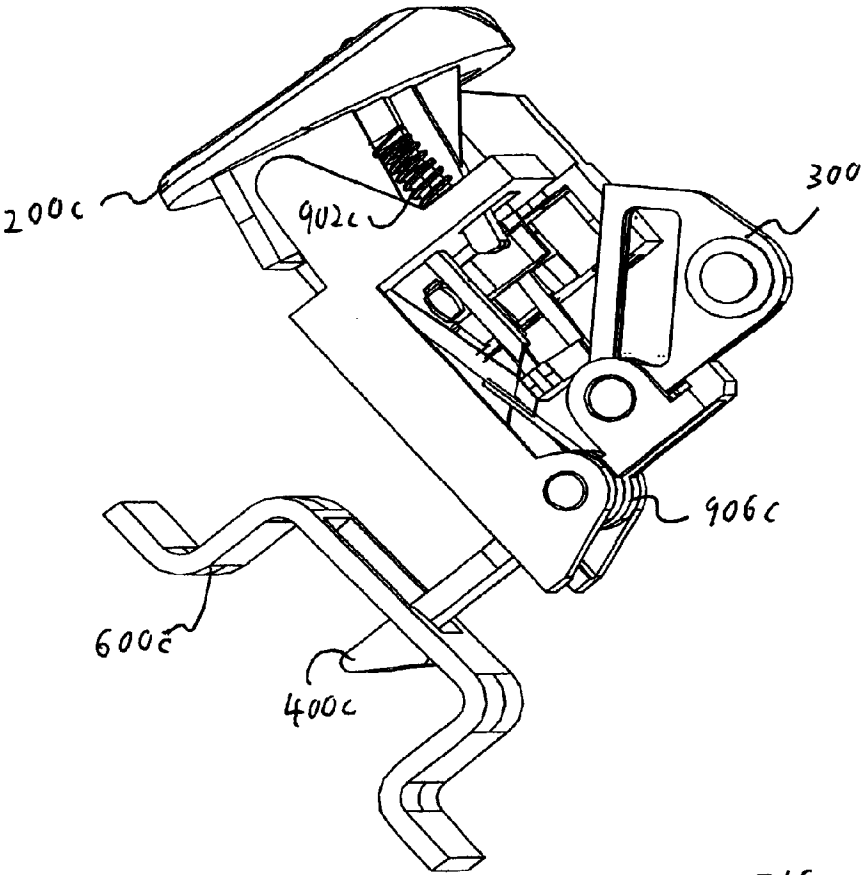
FIG. 35 is a side perspective view of a third embodiment of a gravity-sensitive latch according to the present invention, showing the pendulum rotated to disengage from the button.

Unlatching of the latch 10*c* is controlled by the position of the pendulum 300. When the latch 10*c* is in its horizontal position, as illustrated in FIG. 34, the pendulum 300 is rotated to engage the button 200*c*. Depressing the button 200*c* will therefore push rearward on the pendulum 300 and the upper end 454*c* of the pawl 400*c*, unlatching the latch 10*c*. When the latch 10*c* is in a vertical orientation, illustrated in FIG. 35, the pendulum 300 pivots away from the button 200*c*, so that pressing the button 200*c* will not unlatch the latch 10*c*. Rotating the latch 10*c* to its horizontal orientation will again rotate the pendulum 300 to abut the button 200*c*, permitting actuation of the latch 10*c*.

Figure 36:
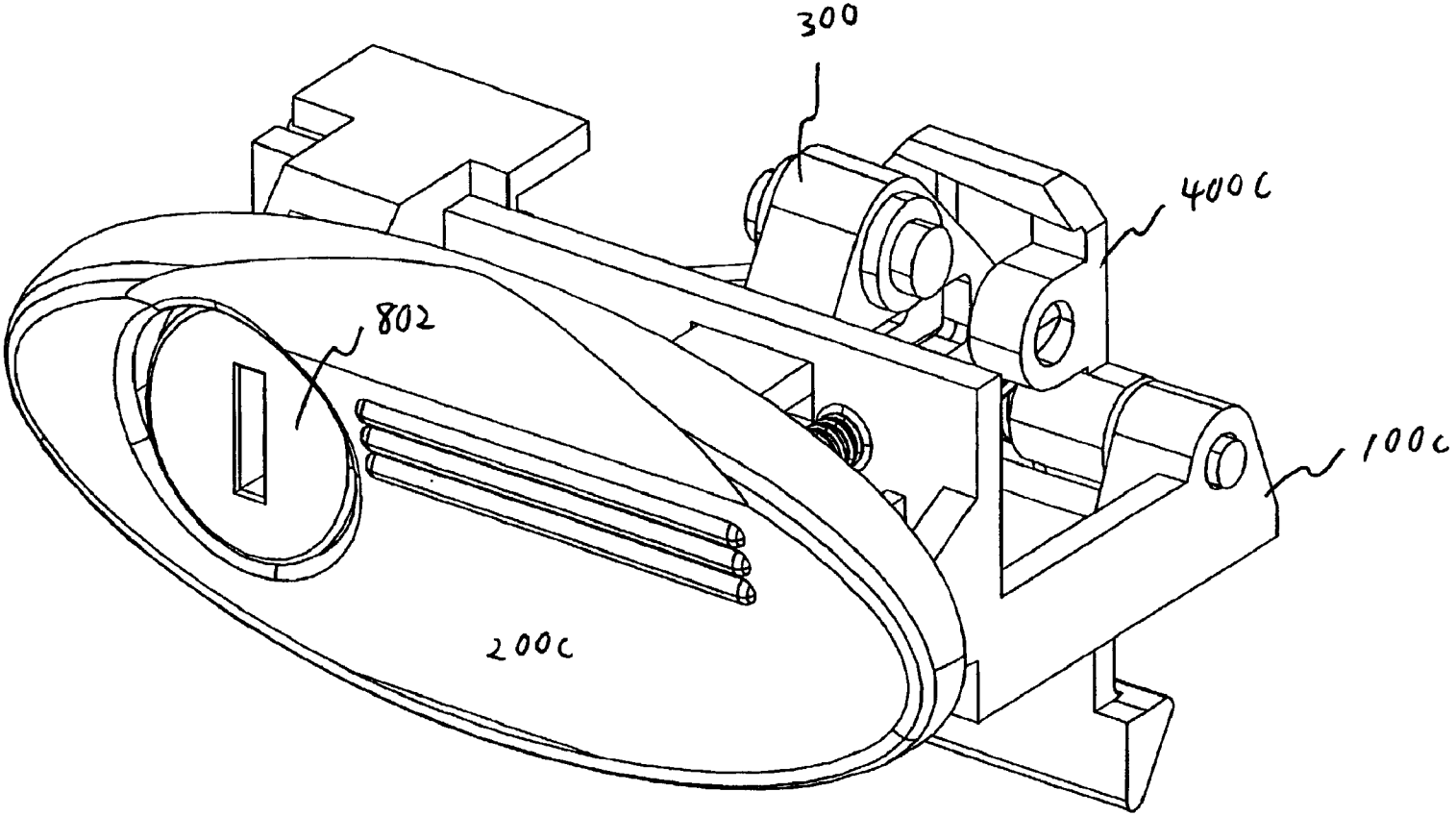
FIG. 36 is a front perspective view of a third embodiment of a gravity-sensitive latch according to the present invention, showing the pendulum abutting the button.
Figure 37:
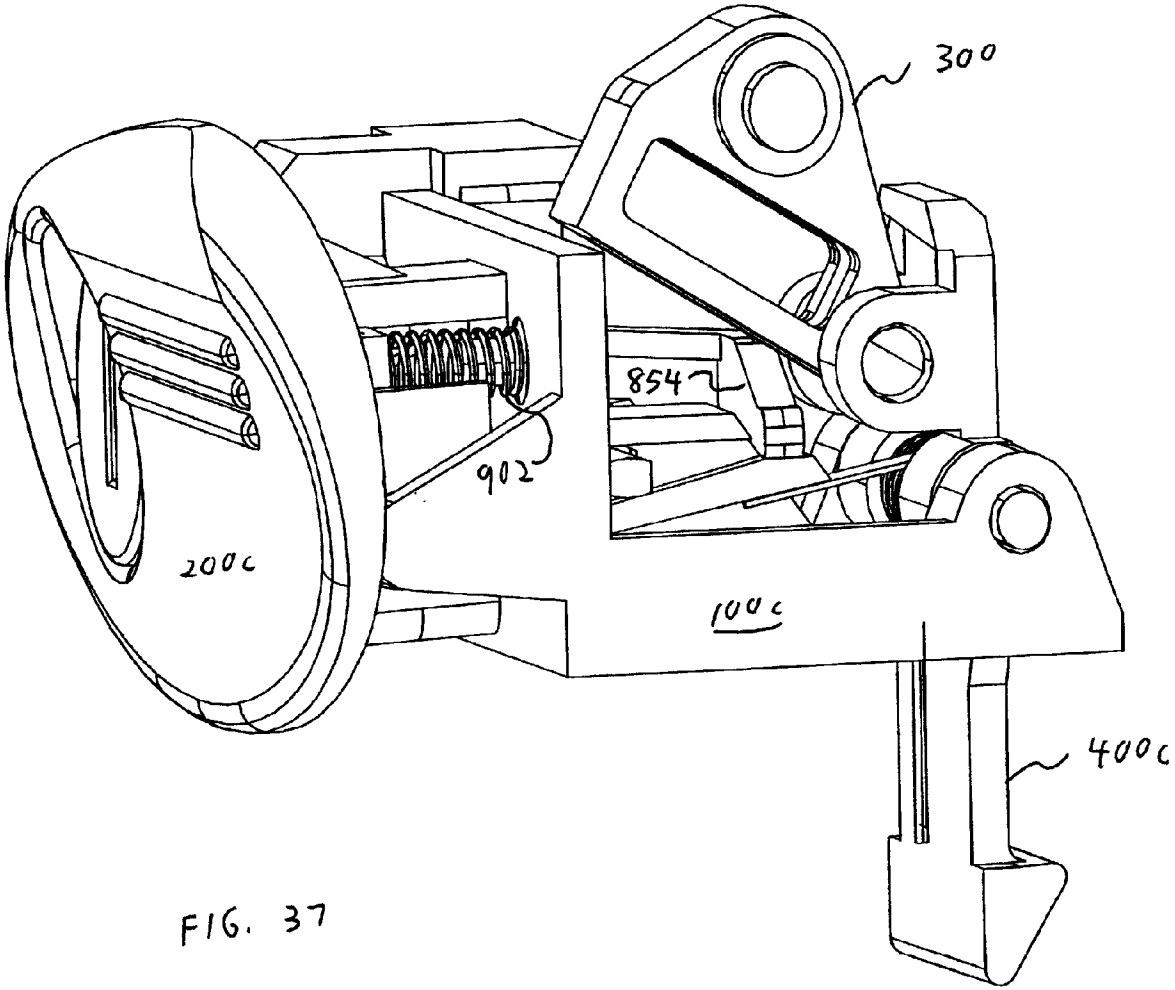
FIG. 37 is a side perspective view of a third embodiment of a gravity-sensitive latch according to the present invention, showing the pendulum rotated to disengage from the button.
Figure 38:
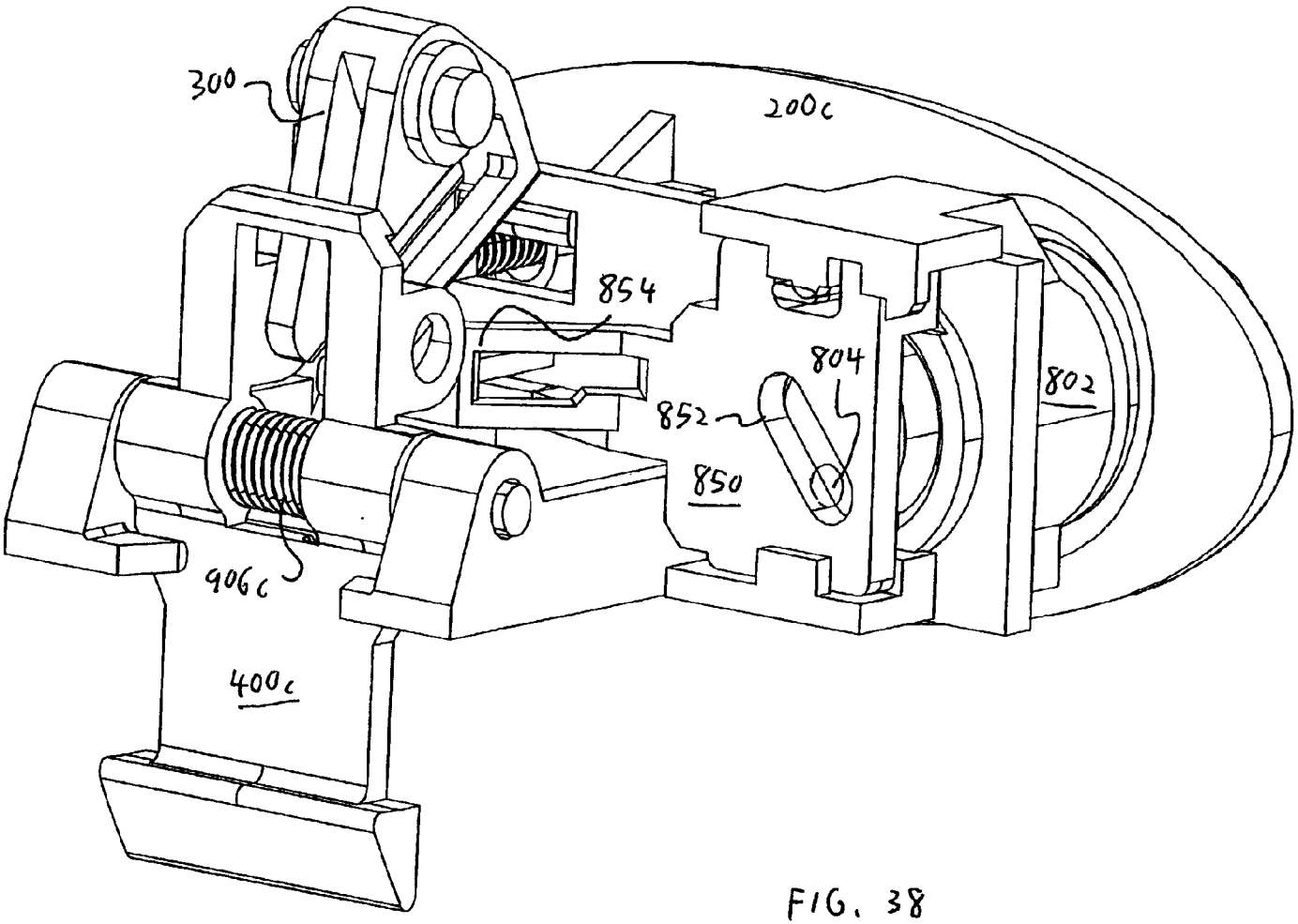
FIG. 38 is a rear perspective view of a third embodiment of a gravity-sensitive latch according to the present invention, showing the pendulum rotated to disengage from the button.
Figure 39:
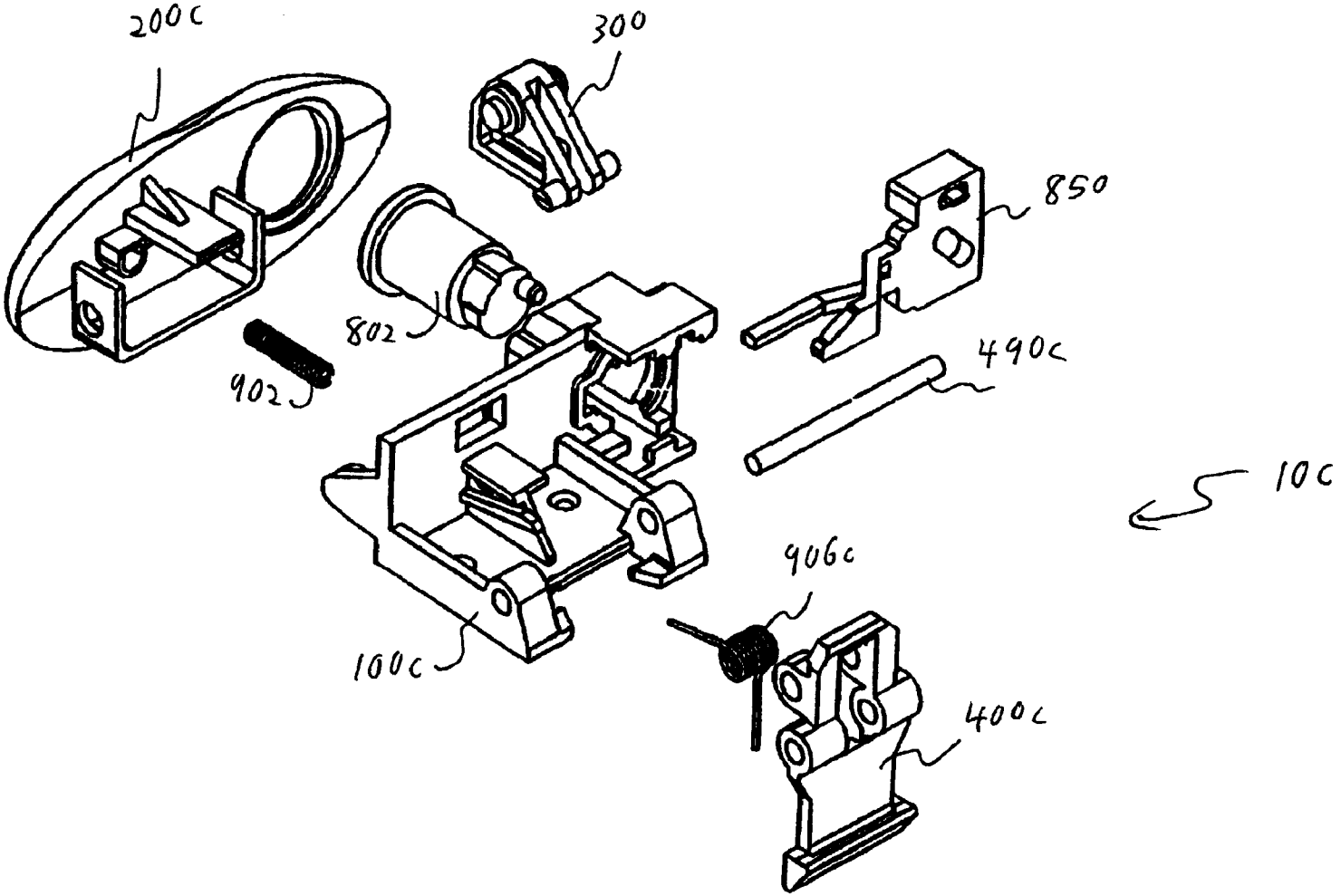
FIG. 39 is an exploded top perspective view of a third embodiment of a gravity-sensitive latch according to the present invention, including a lock plug.
Figure 40:
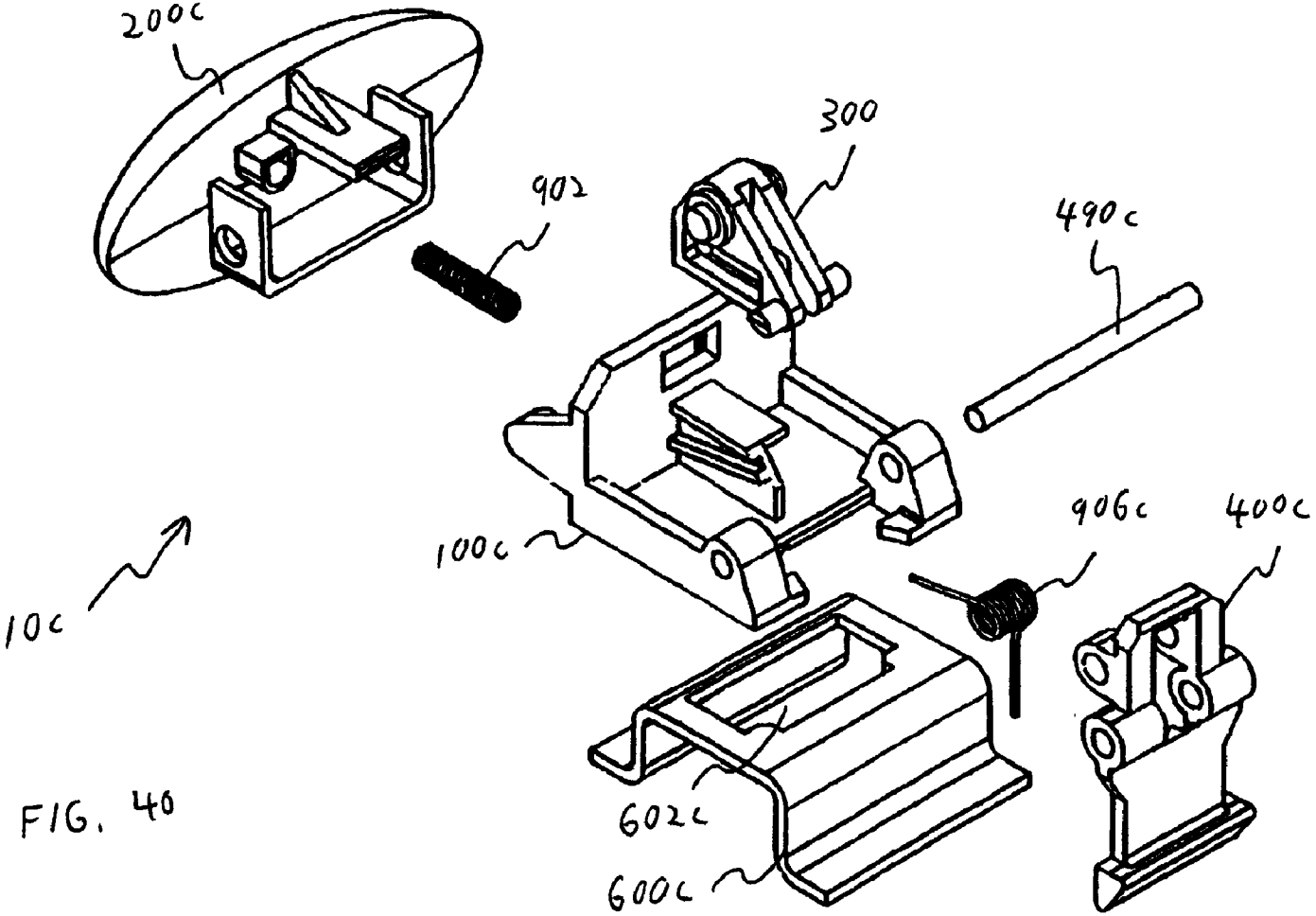
FIG. 40 is an exploded top perspective view of a third embodiment of a gravity-sensitive latch according to the present invention, not including a lock plug.
Figure 43:
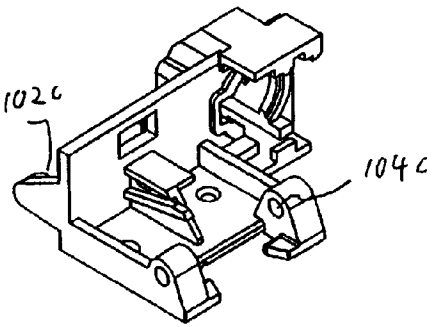
FIG. 43 is a perspective view of a housing for a third embodiment of a gravity-sensitive latch according to the present invention.
Figure 44:
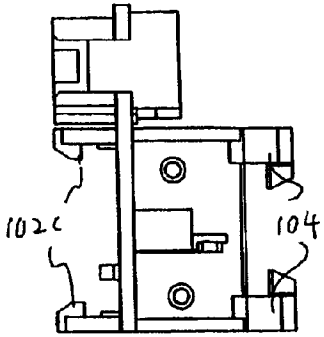
FIG. 44 is a top view of a housing for a third embodiment of a gravity-sensitive latch according to the present invention.
Figure 47:
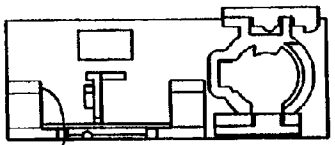
FIG. 47 is a front view of a housing for a third embodiment of a gravity-sensitive latch according to the present invention.
Figure 46:
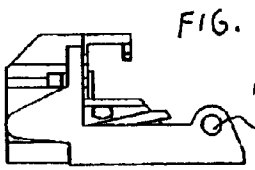
FIG. 46 is a side view of a housing for a third embodiment of a gravity-sensitive latch according to the present invention.
Figure 48:
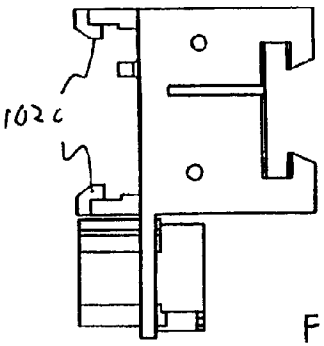
FIG. 48 is a bottom view of a housing for a third embodiment of a gravity-sensitive latch according to the present invention.
Figure 45:
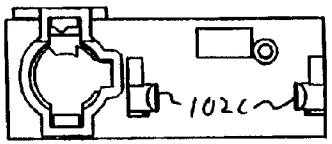
FIG. 45 is a back view of a housing for a third embodiment of a gravity-sensitive latch according to the present invention.

Any of the preferred latches 10 may include a lock 800 for preventing actuation of the latch 10 regardless of its orientation. A preferred and suggested lock 800 includes a standard lock plug 802 (FIGS. 54–55) having a pin 804 at its rear end, and a keyhole 806 at its front end. A locking arm 850 (FIGS. 49–51) is slidably mounted to the rear of the lock plug 802. The locking arm 850 includes a diagonal slot 852 at one end, dimensioned and configured to receive the pin 804 of the lock plug 802. The opposite end of the locking arm 850 includes a ramp 854 dimensioned and configured to push the pendulum 300 out of engagement with the button or handle 200. Turning the key in the lock plug 802 rotates the pin 804, thereby pushing the locking arm 850 under the pendulum 300, moving the pendulum 300 away from the button 200, as illustrated in FIGS. 37–38. Turning the key in the opposite direction slides the locking arm 850 away from the pendulum 300, thereby removing the locking arm 850 from engagement with the pendulum 300 and permitting free rotation of the pendulum 300, as illustrated in FIG. 36.

It is to be understood that the invention is not limited to the preferred embodiments described herein, but encompasses all embodiments within the scope of the following claims.

What is claimed is:

1. A gravity-sensitive latch comprising:

a housing;

a handle pivotally secured to said housing, said handle pivoting between a latched position and an unlatched position;

a pawl pivotally secured to said housing, said pawl being dimensioned and configured to engage a keeper, said pawl pivoting between a latched position and an unlatched position;

a pawl-retaining arm pivoting between a latched position and an unlatched position;

a pendulum pivotally secured to said pawl-retaining arm, said pendulum being dimensioned and configured to abut said handle, said pendulum pivoting between a latched position and an unlatched position; and means for pivotally securing said housing and said pawl-retaining arm, wherein said pawl includes an upper forward arm and a lower forward arm extending toward said handle, a channel between said forward arms, and a third arm extending rearward, said third arm is dimensioned and configured to engage said pawl-retaining arm, said forward arms are dimensioned and configured to secure a keeper, said pawl pivots between said latched position wherein said forward arms are substantially horizontal, and said unlatched position wherein said forward arms point downward.

2. The gravity-sensitive latch according to claim 1, wherein said latch can be actuated when said latch is in a horizontal position, and said latch cannot be actuated when said latch is in a vertical position.

3. The gravity-sensitive latch according to claim 1, wherein said housing is dimensioned and configured to receive a keeper.

4. The gravity-sensitive latch according to claim 1, wherein: said housing includes a front end, a central portion defining a channel dimensioned and configured to receive said pawl and a keeper, and a rear portion having at least one aperture for attachment to said means for pivotally securing said housing and said pawl-retaining arm, said means for pivotally securing said housing and said pawl-retaining arm comprising a pin, said channel dimensioned and configured to pivotally secure said pawl within said housing and said handle includes a vertical portion, a horizontal portion, and a rear end dimensioned and configured to engage with said front end of said housing.

5. The gravity-sensitive latch according to claim 4, wherein said handle includes a rearward-projecting structure for abutting said pendulum and said handle is biased towards its latched position by biasing means wherein the engagement portion of said rear end of said handle that engages with said front end of said housing is positioned below said rearward-projecting flange and said biasing means.

6. The gravity-sensitive latch according to claim 1, wherein said handle includes a rearward-projecting structure for abutting said pendulum.

7. The gravity-sensitive latch according to claim 1, wherein said handle includes a stop to prevent travel beyond a predetermined range of motion.

8. The gravity-sensitive latch according to claim 1, wherein said handle is biased towards its latched position.

9. The gravity-sensitive latch according to claim 1, wherein said pawl retaining arm is biased towards its latched position.

10. The gravity-sensitive latch according to claim 1, wherein said paw retaining arm is pivotally secured to said housing at its end adjacent to said pawl.

11. The gravity-sensitive latch according to claim 1, wherein said pendulum has a connection corner, a weighted corner, and an abutment corner dimensioned and configured to abut said handle.

12. The gravity-sensitive latch according to claim 11, wherein said weighted corner extends upward.

13. The gravity-sensitive latch according to claim 11, wherein said weighted corner has greater mass than the remainder of said pendulum.

14. The gravity-sensitive latch according to claim 1, wherein said pawl retaining arm includes a first end having at least one flange defining at least one aperture and a second end dimensioned and configured to engage said pawl, said pendulum has at least one peg protruding from said pendulum, said at least one aperture of said first end is dimensioned and configured to receive said peg of said pendulum.

15. The gravity-sensitive latch according to claim 1, wherein said pawl is biased towards its unlatched position.

16. The gravity-sensitive latch according to claim 1, wherein said means for pivotally securing said housing and said pawl-retaining arm is a pin.

17. The gravity-sensitive latch according to claim 1, further comprising a keeper adapted for engaging with said pawl.

18. A gravity-sensitive latch comprising:

a housing;

a handle secured to said housing;

a pendulum operatively in communication with said handle, said pendulum pivoting between said operative position and a non-operative position out of communication with said handle under the force of gravity;

a pawl pivotally connected to said housing for pivoting between a latch position and an unlatch position a pawl-retaining arm for engaging or disengaging with said pawl by pivoting between a first position and a second position; and means for pivotally securing said housing and said pawl-retaining arm.

19. A gravity-sensitive latch, comprising:

a housing;

a pawl mounted to said housing for movement relative thereto;

means connected to said pawl for biasing its position;

a manually operated activator structure mounted to said housing;

means mounted to said housing for selectively engaging said pawl for locking it against movement;

means connected to said selectively engaging means for biasing its position; and means, having an interposed position and non-interposed position, for transferring the manually operated motion of said activator structure to said selectively engaging means thereby altering its engagement with said pawl, when said transferring means is in its interposed position between said activator structure and said transferring means;

wherein said linking means is gravity-sensitive to move between its interposed position and its non-interposed position as a function of said housing physical orientation with respect to the earth gravitational force.

20. The gravity-sensitive latch of claim 19, wherein said transferring means moves to its interposed position when said housing is moved to a horizontal position and wherein said transferring means moves to its non-interposed position when said housing is moved to a vertical position.

21. The gravity-sensitive latch of claim 20, wherein said selectively engaging means is pivotally mounted to said housing.

22. The gravity-sensitive latch of claim 21, wherein said transferring means is pivotally mounted to said selectively means.

23. The gravity-sensitive latch of claim 22, wherein said manually operated activator structure includes:

a handle pivotally mounted to said housing;

means for biasing the handle to an outward position; and a flange member rearward projecting from said handle and being sized and positioned to engage said transferring means when said handle is manually moved.

24. The gravity-sensitive latch of claim 23, wherein said pawl is mounted to said housing for rotational movement, said pawl including:

a pair of forward extending arms for engaging a keeper in a closed position;

wherein said pawl biasing means biases said pawl to the open position; and wherein said pawl also includes a rearward projecting arm.

25. The gravity-sensitive latch of claim 24, wherein said selectively engaging means is a retaining arm mounted to pivot on said housing to engage on its free end the rearward projecting arm of said pawl, and wherein said selectively engaging means biasing means biases said retaining arm to engagement with said pawl thereby retaining said pawl in the closed position.

26. The gravity sensitive latch of claim 25 wherein said transferring means is a pendulum pivotally mounted to said retaining arm, said pendulum being operable to swing to the interposed position for abutment with said handle flange member, which movement thereby moves the retaining arm away from said retaining engagement with said pawl, whereby said pawl is free to rotate to the open position.

27. The gravity sensitive latch of claim 26, wherein said pendulum is triangular in shape, having a pivotal connection corner, a weighted corner an a flange abutment corner.

28. The gravity-sensitive latch of claim 19, wherein said keeper-engaging member is a pawl pivotally mounted to said housing.

29. The gravity-sensitive latch of claim 28, wherein said linking means is pivotally mounted to said pawl.

30. The gravity-sensitive latch of claim 29, wherein said manually operated activator structure includes:

a handle pivotally mounted to said housing;

means for biasing the handle to an outward position; and a flange member rearward projecting from said handle and being sized and positioned to engage said transferring means when said handle is manually moved.

31. The gravity-sensitive latch of claim 30, wherein said pawl pivotal mounting to said housing is at a first location on said pawl and wherein said transferring means pivotal mounting to said pawl is at a second location on said pawl.

32. The gravity-sensitive latch of claim 31, wherein said transferring means pivotal mounting second location is at a first end of said pawl; and wherein said pawl includes a hook at the second end thereof for engaging a keeper.

33. The gravity-sensitive latch of claim 32, wherein said pivotal mounting at first location on said pawl is adjacent said pivotal mounting at said second location on said pawl.

34. The gravity-sensitive latch of claim 33, wherein said transferring means is a pendulum pivotally mounted to said pawl at said second location said pendulum being operable to swing to the interposed position for abutment with said handle flange member, which movement thereby moves the pawl to rotate thereby moving the hook away from its keeper engaging position.

35. The gravity-sensitive latch of claim 34 wherein said pendulum is triangular in shape, having a pivotal connection corner, a weighted corner and a flange abutment corner.

36. A gravity-sensitive latch, comprising:

a housing;

a pawl connected to said housing for movement relative thereto;

means connected to said pawl for biasing its position;

a manually operated activator structure mounted to said housing for movement; and means, having an interposed state end non-interposed state, for transferring the manually operated motion of said activator structure to said pawl when said linking means is in its interposed state;

wherein said tranferring means is gravity-sensitive to move between its interposed state and its non-interposed state.

37. The gravity-sensitive latch of claim 36, wherein said transferring means moves to its interposed state when said housing is moved to a horizontal position and wherein said linking means moves to its non-interposed state when said housing is moved to a vertical position.

38. The gravity-sensitive latch of claim 37, also including:

a key operated lock operable between a looked position and an unlocked position; and a locking structure connected to said lock for movement when said key operated lock is turned;

wherein said locking structure intercepts said transferring means when said lock is in the locked position, whereby said locking structure biases said transferring means in its non-interposed position.

39. In a latch, having a housing, a keeper-engaging member associated with said housing an activator member connected with said housing and movable with respect thereto, and means connected with said housing for connecting said activator member to said keeper-engaging member whereby a movement of said activator member moves said keeper-engaging member, the improvement comprising:

a gravity-sensitive link included in said activator member to said keeper-engaging member connecting means, said gravity-sensitive link moving to dislocate said connecting means connection of said activator member to keeper-engaging member when said housing is moved into a first position, and said gravity-sensitive link moving to make said connecting means connection of said activator member to keeper-engaging member when said housing is moved into a second position.

40. The gravity-sensitive latch of claim 39, wherein said activator member is a button supported for slidable movement relative to said housing, said button secured to said housing;

wherein said gravity-sensitive link is a pendulum operatively connected to said button, said pendulum pivoting between a latched position and an unlatched position; and wherein said keeper-engaging member is a pawl pivotally secured to said pendulum, said pawl being dimensioned and configured to engage a keeper, said pawl pivoting between a latched position and an unlatched position; and also including means for pivotally securing said housing and said pawl-retaining arm, wherein said means for pivotally securing said housing and said pawl-retaining arm is a rod.

41. The gravity-sensitive latch according to claim 40, wherein said latch can be actuated when said latch is in a horizontal position, and said latch cannot be actuated when said latch is in a vertical position.

42. The gravity-sensitive latch according to claim 40, wherein said housing includes a front end dimensioned and configured for securing to said button, and a rear portion dimensioned and configured for securing to said pawl.

43. The gravity-sensitive latch according to claim 40, wherein said button includes a structure for abutting said pendulum.

44. The gravity-sensitive latch according to claim 40, wherein said button includes a stop to prevent travel beyond a predetermined range of motion.

45. The gravity-sensitive latch according to claim 40, wherein said button is biased away from said housing towards its forward position.

46. The gravity-sensitive latch according to claim 40, wherein button is dimensioned and configured to receive a lock.

47. The gravity-sensitive latch according to claim 40, wherein said pendulum has a connection corner, a weighted corner, and an abutment corner dimensioned and configured to abut said button.

48. The gravity-sensitive latch according to claim 47, wherein said weighted corner extends upward.

49. The gravity-sensitive latch according to claim 47, wherein said weighted corner has greater mass than the remainder of said pendulum.

50. The gravity-sensitive latch according to claim 40, wherein said pawl includes an upper end dimensioned and configured for pivotally securing with said pendulum, a lower end dimensioned and configured to engage a keeper, and a central section dimensioned and configured for pivotally securing with said housing.

51. The gravity-sensitive latch according to claim 50, wherein said pawl pivots between said latched position wherein said lower end is rearward, and said unlatched position wherein said lower end is forward.

52. The gravity-sensitive latch according to claim 40, wherein said pawl is biased towards its latched position.

53. The gravity-sensitive latch according to claim 40, further comprising a keeper.

54. The gravity-sensitive latch according to claim 53, wherein said keeper is a plate having an opening dimensioned and configured to engage with said pawl.

55. The gravity-sensitive latch according to claim 40, further comprising a lock for preventing actuation of said latch regardless of its orientation.

* * * * *

UNITED STATES PATENT AND TRADEMARK OFFICE

CERTIFICATE OF CORRECTION

PATENT NO. : 6,966,583 B2
DATED : November 22, 2005
INVENTOR(S) : Lianli Ji et al.

It is certified that error appears in the above-identified patent and that said Letters Patent is hereby corrected as shown below:

Column 1,
Line 22, replace “to the T-shaped slot.” with -- of the T-shaped slot. --;

Column 3,
Line 31, replace “paw-retaining” with -- pawl-retaining --;

Column 10,
Line 42, insert -- a -- between “to” and “position”;
Line 45, replace “he hosing” with -- the housing --;
Line 63, replace “though” with -- through --;

Column 13,
Line 44, replace “paw” with -- pawl --;

Column 14,
Line 9, replace “latch” with -- latched -- and replace “unlatch” with -- unlatched --;
Line 52, insert -- engaging -- before “means”;

Column 15,
Line 19, replace “an” with -- and --;
Line 60, replace “end” with -- and --;

Column 16,
Line 7, replace “looked” with -- locked --.

Signed and Sealed this

Twenty-eighth Day of March, 2006

JON W. DUDAS
*Director of the United States Patent and Trademark Office*